US009884326B2

(12) United States Patent
Oki et al.

(10) Patent No.: US 9,884,326 B2
(45) Date of Patent: Feb. 6, 2018

(54) MATRIX FOR MAGNETIC SEPARATOR AND MAGNETIC SEPARATOR

(71) Applicant: National Institute of Advanced Industrial Science and Technology, Tokyo (JP)

(72) Inventors: Tatsuya Oki, Ibaraki (JP); Taeko Hazumi, Ibaraki (JP); Tomohiro Noguchi, Ibaraki (JP)

(73) Assignee: National Institute of Advanced Industrial Science and Technology (JP)

( * ) Notice: Subject to any disclaimer, the term of this patent is extended or adjusted under 35 U.S.C. 154(b) by 44 days.

(21) Appl. No.: 14/900,795

(22) PCT Filed: Jun. 30, 2014

(86) PCT No.: PCT/JP2014/067387
§ 371 (c)(1),
(2) Date: Dec. 22, 2015

(87) PCT Pub. No.: WO2014/208770
PCT Pub. Date: Dec. 31, 2014

(65) Prior Publication Data

US 2016/0151788 A1 Jun. 2, 2016

(30) Foreign Application Priority Data

Jun. 28, 2013 (JP) ..... 2013-137115

(51) Int. Cl.
*B03C 1/032* (2006.01)
*B03C 1/02* (2006.01)
(Continued)

(52) U.S. Cl.
CPC ..... *B03C 1/02* (2013.01); *B03C 1/032* (2013.01); *B03C 1/034* (2013.01); *B03C 1/0335* (2013.01); *B03C 1/288* (2013.01)

(58) Field of Classification Search
CPC ..... B03C 1/002; B03C 1/02; B03C 1/025; B03C 1/034; B03C 2201/18; B03C 2201/22
See application file for complete search history.

(56) References Cited

U.S. PATENT DOCUMENTS 3,567,026 A * 3/1971 Kolm ..... B03C 1/24 210/222
4,021,308 A * 5/1977 Saxholm ..... C12Q 1/18 435/12
(Continued)

FOREIGN PATENT DOCUMENTS

DE 3744167 7/1989
GB 1371623 10/1974
(Continued)

OTHER PUBLICATIONS

Extended European search report dated Jan. 30, 2017 issued for corresponding EP Application No. 14816609.3.

*Primary Examiner* — Joseph C Rodriguez
(74) *Attorney, Agent, or Firm* — Carmody Torrance Sandak & Hennessey LLP

(57) ABSTRACT

To provide matrix for magnetic separator capable of sorting magnetic and non-magnetic particles highly accurately and efficiently and enabling previous simulative recognition of correct magnetic force distribution in matrix space, and magnetic separator.
Matrix for magnetic separator of present invention includes: entirely approximately wavelike plate-shaped magnetic walls each having orderly structure of wave-shaped bent sections continuously repeatedly formed in wave advancing direction and each having wave height h of ≤1 mm and approximately inverted V- or U-shape; and entirely approxi-
(Continued)

mately box-shaped housing part housing magnetic walls and having in opposite surfaces, introducing and discharging parts through which sorting target fluid containing magnetically-attractable substance magnetically-attractable to magnetic walls is passed thereinto/therefrom, magnetic walls arranged in juxtaposition such that convex shapes of wave-shaped bent sections in one magnetic wall face concave shapes thereof in another magnetic wall adjacent to one magnetic wall with constant interval therebetween.

7 Claims, 18 Drawing Sheets

(51) Int. Cl.

| | |
|---|---|
| ***B03C 1/033*** | (2006.01) |
| ***B03C 1/28*** | (2006.01) |
| ***B03C 1/034*** | (2006.01) |

(56) References Cited

U.S. PATENT DOCUMENTS

| | | | | |
|---|---|---|---|---|
| 4,209,394 | A * | 6/1980 | Kelland | B03C 1/034 210/222 |
| 5,137,629 | A | 8/1992 | Dauchez | |
| 5,514,340 | A * | 5/1996 | Lansdorp | B03C 1/002 209/223.1 |
| 5,538,701 | A * | 7/1996 | Avens | C01G 56/004 209/8 |
| 5,543,289 | A * | 8/1996 | Miltenyi | B03C 1/002 209/213 |
| 6,241,894 | B1 * | 6/2001 | Briggs | B03C 1/035 210/222 |
| 7,535,329 | B2 * | 5/2009 | Gorshkov | G01R 33/3806 335/296 |
| 9,607,864 | B2 * | 3/2017 | Zhang | H01L 21/67017 |
| 2010/0300978 | A1 * | 12/2010 | Ramadan | B03C 1/0332 210/695 |
| 2012/0255913 | A1 * | 10/2012 | Tung | B03C 1/0332 210/695 |
| 2016/0216270 | A1 * | 7/2016 | Miltenyi | A61M 1/3693 |
| 2016/0236204 | A1 * | 8/2016 | Bhakdi | B03C 1/01 |

FOREIGN PATENT DOCUMENTS

| | | |
|---|---|---|
| GB | 1576071 | 10/1980 |
| JP | 11-047632 | 2/1999 |
| JP | 2006-341202 | 12/2006 |
| JP | 2012-184282 | 9/2012 |
| WO | 2012-118221 | 9/2012 |

* cited by examiner

PRIOR ART

PRIOR ART

MATRIX FOR MAGNETIC SEPARATOR AND MAGNETIC SEPARATOR

TECHNICAL FIELD

The present invention relates to a matrix for a magnetic separator based on a magnetic separation method, and to a magnetic separator including the matrix for a magnetic separator.

BACKGROUND ART

A magnetic force of attracting a magnetic particle to a magnet is represented by a product between a magnetic flux density (B) and a magnetization gradient (AB) at a position at which the magnetic particle is placed. A magnetic separation method of placing thin lines of a ferromagnet under a uniform magnetic field and generating a high magnetization gradient near the thin lines was proposed in the late 1960s and then evolved to high gradient magnetic separators in the United States. Nowadays, magnetic separators utilizing similar principles are sold by many magnetic separator manufacturers.

For example, a Jones-type wet high gradient magnetic separator is widely used as the magnetic separator. FIGS. 1A and 1B are depictive diagrams depicting overviews of a Jones-type wet high gradient magnetic separator.

As illustrated in FIG. 1A, a magnetic separator 100 includes as main members, a high gradient magnetic separating section 50 including an electromagnet 50*a*, a magnetic filter 50*b*, and a magnetic separation flow path 50*c*, a sorting target fluid introducing flow path 101*b* coupled to one end of the magnetic separation flow path 50*c* via an on-off valve 101*a* and capable of introducing a sorting target fluid into the magnetic separation flow path 50*c*, a non-magnetically attractable substance discharging flow path 103*b* coupled to the other end of the magnetic separation flow path 50*c* via an on-off valve 103*a* and capable of discharging from the magnetic separation flow path 50*c*, the sorting target fluid from which any magnetically-attractable substance has been magnetically attracted to the magnetic filter 50*b*, a carrier fluid introducing flow path 104*b* coupled to the other end of the magnetic separation flow path 50*c* via an on-off valve 104*a* and capable of introducing into the magnetic separation flow path 50*c*, a carrier fluid (e.g., water) capable of carrying the magnetically attractable substance detached from the magnetic filter 50*b*, and a magnetically attractable substance discharging flow path 105*b* coupled to the one end of the magnetic separation flow path 50*c* via an on-off valve 105*a* and capable of discharging from the magnetic separation flow path 50*c*, the carrier fluid carrying the magnetically attractable substance detached from the magnetic filter 50*b*.

The magnetic separator 100 is configured to sort out the magnetically attractable substance and the non-magnetically attractable substance by separating them from the sorting target fluid.

First, as illustrated by arrows in FIG. 1A, only the on-off valve 101*a* of the on-off valves on the one end of the magnetic separation flow path 50*c* is opened to the magnetic separation flow path 50*c* in a state that the electromagnet 50*a* is excited, to introduce into the magnetic separation flow path 50*c*, the sorting target fluid introduced into the sorting target fluid introducing flow path 101*b* by means of a pump 101*d* from a storing section 101*c* storing the sorting target fluid and have the magnetically attractable substance magnetically attracted to the magnetic filter 50*b*, and only the on-off valve 103*a* of the on-off valves on the other end of the magnetic separation flow path 50*c* is opened to discharge the sorting target fluid from which the magnetically attractable substance has been magnetically attracted into the non-magnetically attractable substance discharging flow path 103*b* and recover the sorting target fluid into a non-magnetically attractable substance recovering section 103*c* (a non-magnetically attractable substance sorting step).

Next, as illustrated by arrows in FIG. 1B, only the on-off valve 104*a* of the on-off valves on the other end of the magnetic separation flow path 50*c* is opened to the magnetic separation flow path 50*c* in a state that the electromagnet 50*a* is released from excitation, to introduce the carrier fluid into the magnetic separation flow path 50*c* from the carrier fluid introducing flow path 104*b*, and only the on-off valve 105*a* of the on-off valves on the one end of the magnetic separation flow path 50*c* is opened to let the carrier fluid carry the magnetically attractable substance detached from the magnetic filter 50*c* to discharge the magnetically attractable substance from the magnetic separation flow path 50*c* into the magnetically attractable substance discharging flow path 105*b* and recover the magnetically attractable substance into a magnetically attractable substance recovering section 105*c* (a magnetically attractable substance sorting step).

A magnetic filter used in a magnetic separator is called matrix, and there are known matrices made of an expanded metal, steel wool, an iron ball, etc. (see PTL 1). Particularly, matrices made of an expanded metal and steel wool generate a locally-high magnetization gradient (AB), and are hence widely used for magnetically attracting magnetically attractable substances securely with a strong magnetic force.

The present applicant has previously invented and filed a patent application for a technique of sorting red, blue, and green phosphors from a mixture of phosphors color by color by means of a magnetic force with a high gradient magnetic separator (see PTL 2).

However, matrices made of an expanded metal, steel wool, etc., in which ferromagnet thin lines constituting the expanded metal, the steel wool, etc. are disposed in an intricately entwined state, have a problem that not only magnetic particles magnetically attractable to the ferromagnet thin lines but also many non-magnetic particles unintended for being magnetically attracted to the ferromagnet thin lines get entangled into the structure of the ferromagnet thin lines, leading to a poor sorting accuracy. Particularly, at a position at which a locally-high magnetization gradient (ΔB) is generated, magnetic particles magnetically attracted thereto earlier impede passage of non-magnetic particles to come later and block the flow path, leading to a large amount of non-magnetic particles entangled.

To overcome these problems, it is conceivable to dispose the ferromagnet thin lines sparsely. However, ferromagnet thin lines, which although can generate a locally-high magnetization gradient (ΔB), put many spatial regions under a low magnetization gradient (ΔB). Therefore, sparsely disposed ferromagnet thin lines restrict the area effective for magnetically attracting magnetic particles and allow magnetic particles to get through the ferromagnet thin lines via the spaces under the low magnetization gradient (ΔB), leading to the problem of the poor sorting accuracy.

To overcome these problems, it is necessary to figure out an appropriate magnetization gradient (ΔB) in the matrix space. However, matrices made of an expanded metal, steel wool, etc., in which the ferromagnet thin lines are disposed in the matrices in an irregular disposition, have a problem of rejecting previous recognition of a correct magnetic force distribution in the matrix space by simulation or the like.

Hence, magnetic separators using conventional matrices are operated in a manner that the matrix is used in a state that ferromagnet thin lines are disposed in an intricately entwined state, and magnetic particles are detached and recovered from the ferromagnet thin lines frequently before many non-magnetic particles are entangled into the ferromagnet thin lines. This entails a problem that an amount processable by one detaching/recovering operation is low, leading to a poor sorting efficiency.

Further, because of the incapability of previously recognizing a correct magnetic force distribution in the matrix space by simulation or the like, it is unknown until a matrix is actually prototyped and used for a sorting test whether the matrix has a good performance or not, which has disturbed development of a high-performance matrix.

CITATION LIST

Patent Literature

PTL 1: Japanese Patent Application Laid-Open (JP-A) No. 11-47632

PTL 2: JP-A No. 2012-184282

SUMMARY OF INVENTION

Technical Problem

The present invention aims to overcome the various conventional problems described above and achieve the object described below. That is, an object of the present invention is to provide a matrix for a magnetic separator and a magnetic separator, the matrix capable of sorting out magnetic particles and non-magnetic particles with high accuracy and high efficiency and enabling previous recognition of a correct magnetic force distribution in a matrix space by simulation.

To overcome the problems, the present inventors have conducted earnest studies and found it possible to achieve the object described above by structuring a novel matrix based on a concept that is totally opposite to the conventional course of providing an irregular magnetic flux density distribution to provide a high magnetization gradient (ΔB) and thereby magnetically attract magnetic particles into the matrix.

That is, the present inventors have found it possible to obtain a matrix for a magnetic separator capable of sorting out magnetic particles and non-magnetic particles with high accuracy and high efficiency and enabling previous recognition of a correct magnetic force distribution in the matrix space by simulation, by disposing magnetic walls having an orderly structure that provides a relatively uniform magnetic force distribution in the matrix space.

Solution to Problem

The present invention is based on the finding described above, and solutions to the problems described above are as follows.

<1> A matrix for a magnetic separator, including:

entirely approximately wavelike plate-shaped magnetic walls each having an orderly structure in which wave-shaped bent sections each having a wave height h of 1 mm or less and formed in either an approximately inverted V-shape or an approximately inverted U-shape are continuously and repeatedly formed in a wave advancing direction; and an entirely approximately box-shaped housing part housing the magnetic walls and having in opposite surfaces of the housing part respectively, an introducing part and a discharging part through which a sorting target fluid containing a magnetically attractable substance magnetically attractable to the magnetic walls can be passed into and out from the housing part, wherein the magnetic walls are arranged in juxtaposition in a state that convex shapes of the wave-shaped bent sections in one magnetic wall of the magnetic walls and concave shapes of the wave-shaped bent sections in another magnetic wall of the magnetic walls that is adjacent to the one magnetic wall face each other with a constant interval therebetween.

<2> The matrix for a magnetic separator according to <1>, wherein the wave height h of the wave-shaped bent sections and a pitch p between vertices of adjacent ones of the wave-shaped bent sections are set such that nonuniformity N, represented by a formula (1) below, of a magnetic force generated in a space inside the housing part when a magnetic field is applied is less than 1.5, $$N=(B\Delta B25-B\Delta B75)/B\Delta B50 \quad (1)$$

where in the formula (1) above, BΔB25 represents the magnetic force when a magnetic force area cumulative rate of portions at which the magnetic force equal to or greater than a certain value is generated within a cross-section of the space inside the housing part is 25%, BΔB75 represents the magnetic force when the magnetic force area cumulative rate is 75%, and BΔB50 represents the magnetic force when the magnetic force area cumulative rate is 50%, where the cross-section is obtained by sectioning the space inside the housing part along the wave advancing direction at a middle position of the magnetic walls arranged in juxtaposition, the middle position being in a direction of a width of waves.

<3> The matrix for a magnetic separator according to <1> or <2>, wherein a wall material of side surfaces of the housing part that are disposed orthogonally to a magnetic flux direction is made of a magnetic substance, and a wall material of remaining side surfaces of the housing part is made of a non-magnetic substance, where the surfaces of the housing part that have the introducing part and the discharging part respectively are assumed to be a top surface and a bottom surface of the housing part.

<4> The matrix for a magnetic separator according to any one of <1> to <3>, wherein a surface of the magnetic walls is coated with a non-magnetic substance having a relative magnetic permeability of 1.1 or less.

<5> The matrix for a magnetic separator according to any one of <1> to <4>, wherein the magnetic walls are arranged in a state of being inclined from a direction along which the sorting target fluid is introduced into the housing part.

<6> The matrix for a magnetic separator according to any one of <1> to <5>, wherein the magnetic walls have a thickness that increases from the introducing part through which the sorting target fluid is introduced into the housing part toward the discharging part through which the sorting target fluid is discharged from the housing part.

<7> A magnetic separator, including:

the matrix for a magnetic separator according to any one of <1> to <6>.

<8> The magnetic separator according to <7>, further including:

a display unit capable of displaying a magnetic force distribution in the space inside the housing part in real-time, the magnetic force distribution previously calculated by a magnetic field simulation according to output information from an electromagnet.

Advantageous Effects of Invention

According to the present invention, it is possible to overcome the various problems of the conventional techniques and provide a matrix for a magnetic separator and a magnetic separator, the matrix capable of sorting out magnetic particles and non-magnetic particles with high accuracy and high efficiency and enabling previous recognition of a correct magnetic force distribution in a matrix space by simulation.

DESCRIPTION OF EMBODIMENTS (Matrix for a Magnetic Separator)

A matrix for a magnetic separator of the present invention includes magnetic walls and a housing part.

<Magnetic Walls>

The magnetic walls are configured as entirely approximately wavelike plate-shaped members each having an orderly structure in which wave-shaped bent sections each having a wave height h of 1 mm or less and formed in either an approximately inverted V-shape or an approximately inverted U-shape are continuously and repeatedly formed in a wave advancing direction.

The matrix for a magnetic separator configured with the magnetic walls having such an orderly structure can be provided with a relatively uniform magnetic force distribution in the matrix space.

Providing the magnetic walls with the orderly structure makes it possible to overcome blocking in the matrix space due to an irregular structure, to provide a wide effective area that is capable of magnetically attracting a magnetically attractable substance from a sorting target fluid (a sorting target slurry) containing the magnetically attractable substance, to obtain a simulative recognition of a magnetic force distribution in the matrix space, and to set the orderly structure to its optimum structure that is based on the magnetic force distribution.

The magnetically attractable substance refers to a magnetically attractable substance that is set as being magnetically attractable by the matrix for a magnetic separator. The target of this setting may include only a magnetically attractable substance having a high magnetic susceptibility, or may also include a magnetically attractable substance having a low magnetic susceptibility. That is, is it possible to set variably whether a substance is magnetically attractable by the matrix for a magnetic separator or not, based on the level of the density of a magnetic flux generated by an electromagnet of a magnetic separator and the size of a magnetic gradient formed by the matrix for a magnetic separator. Here, a magnetically attractable substance set as being magnetically attractable to the matrix for a magnetic separator is referred to as the magnetically attractable substance, and any other substance than such a magnetically attractable substance is referred to as the non-magnetically attractable substance.

Figure 2A:
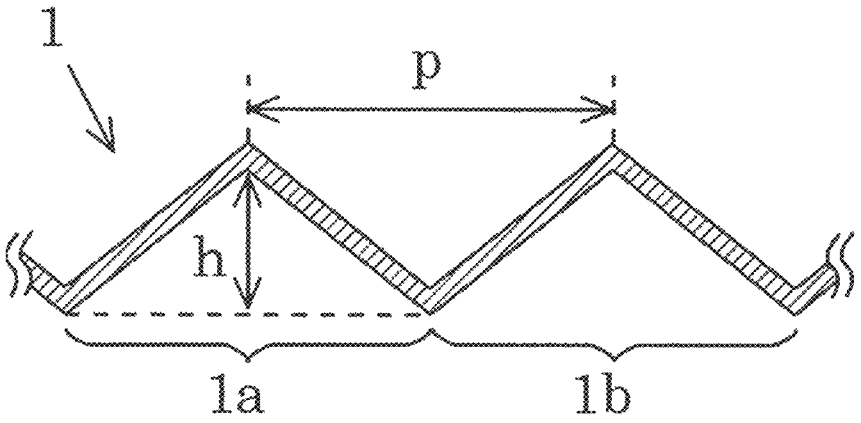
FIG. 2A is a depictive diagram depicting a configuration of a magnetic wall formed in an approximately inverted V-shape.
Figure 2B:
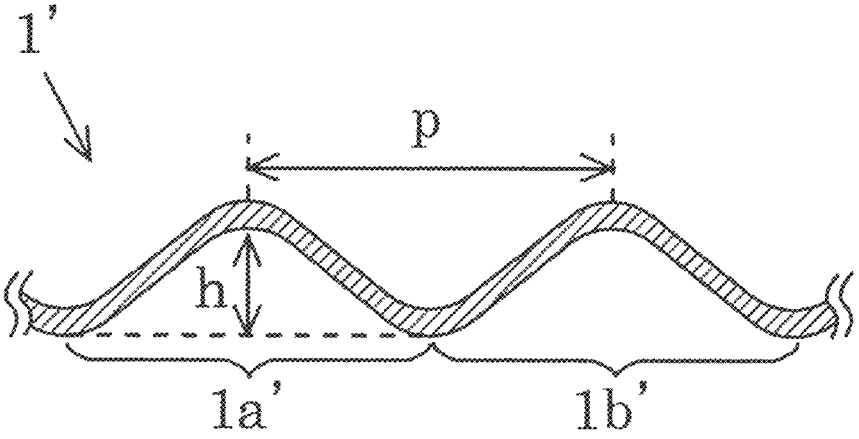
FIG. 2B is a depictive diagram depicting a configuration of a magnetic wall formed in an approximately inverted U-shape.

The wave-shaped bent sections may be formed in either an approximately inverted V-shape or an approximately inverted U-shape as described above. FIG. 2A illustrates a configuration of the magnetic wall in a case where the wave-shaped bent sections are formed in the approximately inverted V-shape. FIG. 2B illustrates a configuration of the magnetic wall in a case where the wave-shaped bent sections are formed in the approximately inverted U-shape.

As illustrated in FIG. 2A, a magnetic wall 1 has an orderly structure in which wave-shaped bent sections 1*a* and 1*b* formed to bend in an approximately inverted V-shape are continuously and repeatedly formed in a wave advancing direction.

In FIG. 2A, the reference sign h denotes a maximum groove depth when the wave-shaped bent section 1*a* (1*b*) is seen as a "groove" from one surface (in the diagram, a lower surface) of the magnetic wall 1. This maximum groove depth is referred to as "wave height h". "Wave height h" mentioned in any other portions herein means the same.

In FIG. 2A, the reference sign p denotes a distance between the vertices of the adjacent wave-shaped bent sections 1*a* and 1*b*. This distance is referred to as "inter-vertex pitch p". "Inter-vertex pitch p" mentioned in any other portions herein means the same.

As illustrated in FIG. 2B, a magnetic wall 1' has an orderly structure in which wave-shaped bent sections 1*a*' and 1*b*' formed to bend in an approximately inverted U-shape are continuously and repeatedly formed in a wave advancing direction. The reference signs h and p mean the same as "wave height h" and "inter-vertex pitch p" described above, respectively.

The matrix for a magnetic separator may be configured based on either shape of the approximately inverted V-shaped magnetic wall 1 and the approximately inverted U-shaped magnetic wall 1'.

The wave height h and the inter-vertex pitch p of the wave-shaped bent sections are not particularly limited. However, from a viewpoint of enhancing uniformity of a magnetic force distribution, it is preferable to set the wave height h and the inter-vertex pitch p such that nonuniformity N, represented by a formula (1) below, of a magnetic force generated in a space (matrix space) inside the housing part when a magnetic field is applied is less than 1.5. From the same viewpoint, it is more preferable to set the wave height h and the inter-vertex pitch p such that the nonuniformity N of the magnetic force is less than 0.7. It is particularly preferable to set the wave height h and the inter-vertex pitch p such that the nonuniformity N of the magnetic force is less than 0.5. That is, a greater nonuniformity N means a greater deviation in the magnetic force distribution. A smaller nonuniformity N means a smaller deviation in the magnetic force distribution. A smaller nonuniformity N is preferable to obtain a uniform magnetic force distribution in the matrix space.

$$N=(B\Delta B25-B\Delta B75)/B\Delta B50 \quad (1)$$

where in the formula (1) above, BΔB25 represents the magnetic force when a magnetic force area cumulative rate of portions at which the magnetic force equal to or greater than a certain value is generated within a cross-section of the space (i.e., a cross-section of the matrix space) inside the housing part is 25%, BΔB75 represents the magnetic force when the magnetic force area cumulative rate is 75%, and BΔB50 represents the magnetic force when the magnetic force area cumulative rate is 50%, where the cross-section is obtained by sectioning the space inside the housing part along the wave advancing direction at a middle position of the magnetic walls arranged in juxtaposition, the middle position being in a direction of a width of waves.

The wave height h and the inter-vertex pitch p of the wave-shaped bent sections are not particularly limited. However, from a viewpoint of realizing efficient sorting with a high magnetic force, it is preferable to set them such that the BΔB50 value representing a typical magnetic force generated in the space (matrix space) inside the housing part when the magnetic field is applied is 20 $T^2$/m or greater, and more preferably 50 $T^2$/m or greater. When the BΔB50 value is less than 20 $T^2$/m, a low magnetic force is available relative to an electric power supplied to the electromagnet configured to apply a magnetic field to the matrix for a magnetic separator, leading to a low efficiency. Hence, a high BΔB50 value is preferable.

The magnetic walls are not particularly limited. However, it is preferable that the surface of the magnetic walls be coated with a non-magnetic substance having a relative magnetic permeability of 1.1 or less. That is, the magnetic walls coated with the non-magnetic substance can make the magnetic force distribution on the surface of the magnetic walls more uniform than when the magnetic walls are not coated. This enables magnetic separation with higher accuracy and higher efficiency.

Such a non-magnetic substance is not particularly limited, and an arbitrary non-magnetic substance may be selected according to the purpose. Examples of such a non-magnetic substance include various resin materials such as polytetrafluoroethylene (i.e., a resin material known as a trademark Teflon) and an epoxy resin, and non-magnetic metals such as copper and aluminum.

The magnetic walls are not particularly limited, and may be formed to have a thickness that increases from the introducing part through which the sorting target fluid is introduced into the housing part toward the discharging part through which the sorting target fluid is discharged from the housing part. In this case, a condition under which some magnetic particles cannot probabilistically approach the magnetic walls on the introducing part side is created by the higher voidage in the matrix space on the introducing part side, which makes the magnetic substance sequentially approach the magnetic walls and be magnetically attracted thereto on the discharging part side. This enables effective use of the magnetic attraction area.

A constituent material of the magnetic walls is not particularly limited so long as it is a magnetic substance. Examples of the constituent material include steels such as SS400, SUS410, and SUS430.

A method for making the magnetic walls is not particularly limited, and examples of the method include methods for making the magnetic walls by known bending fabrication and curving fabrication. A method for coating the magnetic walls with the non-magnetic substance may be any known coating fabrication depending on the material.

The matrix for a magnetic separator includes a plurality of magnetic walls. These magnetic walls are arranged in juxtaposition in a state that convex shapes of the wave-shaped bent sections in one magnetic wall of the magnetic walls and concave shapes of the wave-shaped bent sections in another magnetic wall of the magnetic walls that is adjacent to the one magnetic wall face each other with a constant interval therebetween. This arrangement of the magnetic walls creates a matrix space through which the sorting target fluid is flowed, and also can make the magnetic force distribution in the matrix space relatively uniform.

Figure 2C:
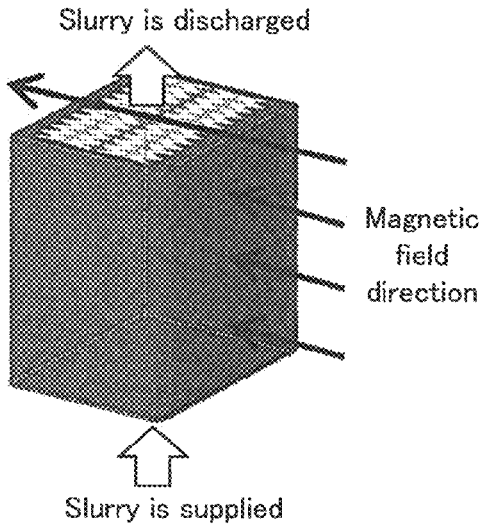
FIG. 2C is a depictive diagram illustrating a configuration example of a matrix for a magnetic separator.

The positions at which the magnetic walls are arranged in the housing part are not particularly limited so long as the magnetic walls are arranged in juxtaposition as described above. Hence, the magnetic walls may be arranged in juxtaposition in the housing part such that the wave advancing direction of the magnetic walls is parallel with the direction along which the sorting target fluid is introduced into the housing part, or the magnetic walls may be arranged in juxtaposition in the housing part such that the wave width direction of the magnetic walls is parallel with the direction along which the sorting target fluid is introduced into the housing part. FIG. 2C illustrates an example of the latter case. FIG. 2C is a depictive diagram illustrating a configuration example of the matrix for a magnetic separator.

In any of these cases, the magnetic walls may be arranged in a state of being inclined from the direction along which the sorting target fluid is introduced into the housing part. In this case, it is easy for the magnetically attractable substance in the sorting target fluid to impinge on the magnetic walls, leading to highly accurate sorting.

<Housing Part>

The magnetic walls are housed in the housing part as described above. The housing part is configured as an entirely approximately box-shaped member having in opposite surfaces of the housing part respectively, the introducing part and the discharging part through which the sorting target fluid containing a magnetically attractable substance magnetically attractable to the magnetic walls can be passed into and out from the housing part. This makes it possible to flow the sorting target fluid through the matrix for a magnetic separator and sort out a magnetically attractable substance and a non-magnetically attractable substance by means of the magnetic walls.

The same material may be used as a wall material for constituting the housing part. However, it is preferable that a wall material of side surfaces of the housing part that are disposed orthogonally to a magnetic flux direction be made of a magnetic substance, and that a wall material of remaining side surfaces be made of a non-magnetic substance, where the surfaces of the housing part that have the introducing part and the discharging part respectively are assumed to be a top surface and a bottom surface of the housing part. In this case, there is little magnetic flux leakage to the outside of the matrix for a magnetic separator, but the magnetic flux can concentrate to within the matrix for a magnetic separator. This makes it possible to provide a high magnetic force in the matrix space. A constituent material of the wall material made of a magnetic substance is not particularly limited, and examples of the constituent material include magnetic materials such as SS400, SU410, and SUS430. A constituent material of the wall material made of a non-magnetic substance is not particularly limited, and examples of the constituent material include non-magnetic materials such as SUS304.

A method for making the housing part is not particularly limited, and examples of the method include a known molding method. The introducing part and the discharging part can be formed by providing appropriate openings or the like in the wall material of the opposite surfaces.

The housing part may be configured as a cuboid box-shaped member. However, the surfaces having the introducing part and the discharging part may be entirely opened. In this case, the housing part may be configured as a tubular member of which two opened surfaces are the introducing part and the discharging part respectively.

Figure 2D:
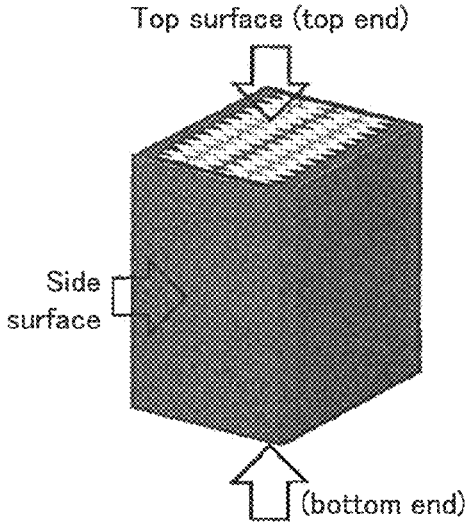
FIG. 2D is a depictive diagram depicting wall surfaces of a matrix for a magnetic separator.

The direction of a magnetic field applied to the matrix for a magnetic separator is a direction orthogonal to the in-plane direction of those side surfaces of the housing part that face wall surfaces of the magnetic walls, where among the wall surfaces constituting the housing part, the wall surfaces having the introducing part and the discharging part are a top surface and a bottom surface, respectively (see FIG. 2D). This makes it easy for a magnetization gradient ($\Delta B$) to be generated in the magnetic walls. FIG. 2D is a depictive diagram depicting the wall surfaces of the matrix for a magnetic separator.

(Magnetic Separator)

A magnetic separator of the present invention includes the matrix for a magnetic separator of the present invention.

The magnetic separator is not particularly limited, and may include a display unit capable of displaying in real-time, a magnetic force distribution in the space inside the housing part that is previously calculated by a magnetic field simulation according to output information from an electromagnet.

For example, the display unit may include a storage unit configured to store a magnetic force distribution in the space inside the housing part that is previously calculated by a magnetic field simulation according to output information from an electromagnet, an operation unit configured to read out from the storage unit, the magnetic force distribution corresponding to the output information from the electromagnet input to the operation unit, and a display configured to display the magnetic force distribution read out from the operation unit.

Figure 1A:
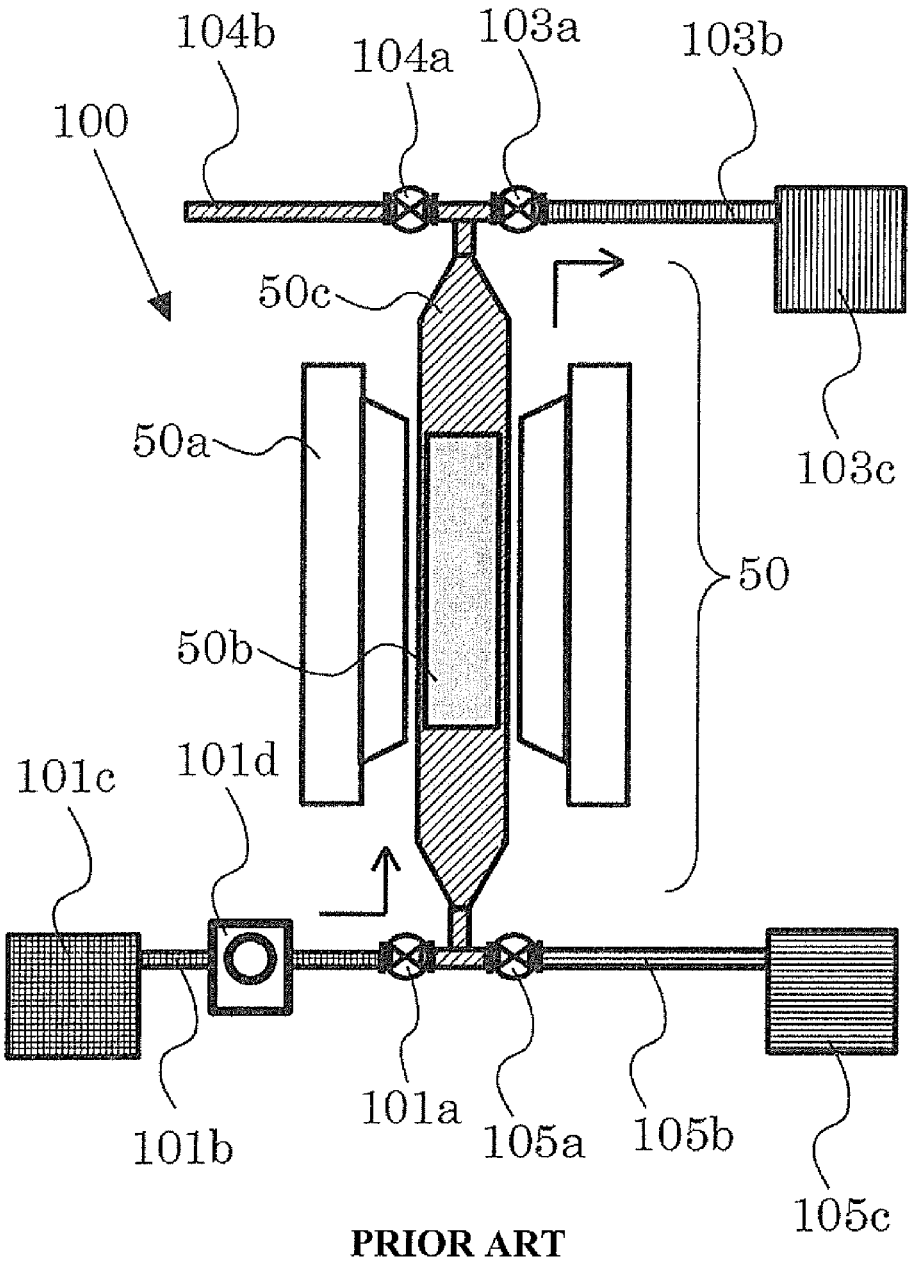
FIG. 1A is a depictive diagram (1) depicting a magnetic separator of a Jones-type wet high gradient magnetic separator.
Figure 1B:
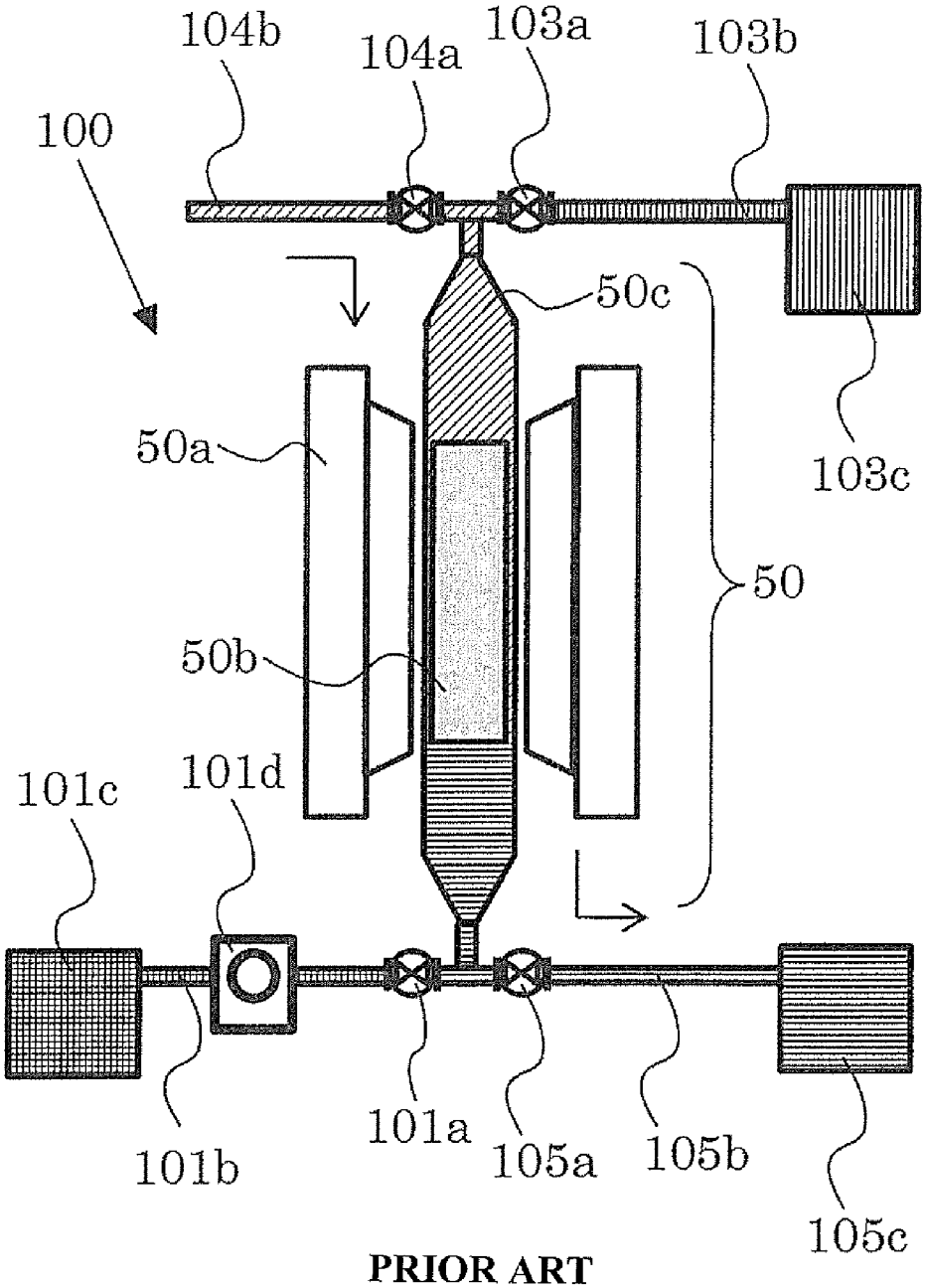
FIG. 1B is a depictive diagram (2) depicting a magnetic separator of a Jones-type wet high gradient magnetic separator.

The configuration of the magnetic separator is not particularly limited in any other way, and the magnetic separator may appropriately employ features of a known magnetic separator (e.g., a Jones-type wet high gradient magnetic separator, see FIGS. 1A and 1B) according to the purpose.

EXAMPLES

Simulation of Magnetic Force Distribution

A magnetic force distribution in a matrix in a case where the matrix for a magnetic separator of the present invention is employed as a matrix for a magnetic separator used in a magnetic separator was simulated with analyzing software (FEMM 4.2, free software created by David Meeker).

Figure 3:
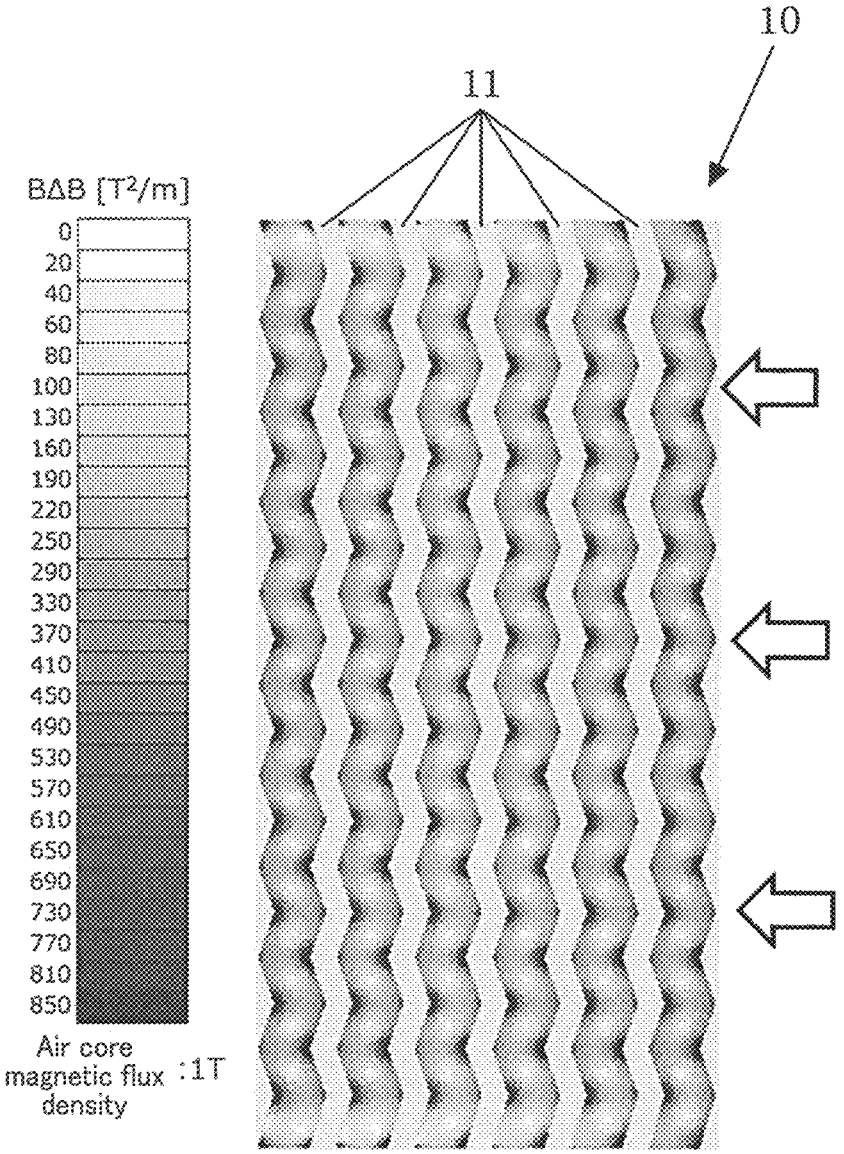
FIG. 3 is a diagram illustrating a configuration of a wavelike matrix for which simulation was conducted, and a result of a finite element method-based simulation of a magnetic force (BΔB) distribution for the wavelike matrix.

FIG. 3 illustrates the configuration of the matrix (wave-like matrix) for a magnetic separator for which the simulation was conducted, and a result of a finite element method-based simulation of a magnetic force (BΔB) distribution for the wavelike matrix (a magnetic force distribution in the matrix space) under a condition that a density of a magnetic flux generated by an electromagnet formed of an air core coil (hereinafter, referred to as air core magnetic flux density) was 1 T.

As illustrated in FIG. 3, a wavelike matrix 10 includes a plurality of entirely approximately wavelike plate-shaped magnetic walls 11 in each of which wave-shaped bent sections each bent in an inverted V-shape when seen in a cross-sectional view are orderly repeatedly formed at regular intervals in a wave advancing direction. The magnetic walls 11 are arranged at constant intervals in juxtaposition in a state that convex shapes of the wave-shaped bent sections in one magnetic wall 11 and concave shapes of the wave-shaped bent sections in another adjacent magnetic wall 11 face each other.

The simulation assumed a case where the constituent material of the magnetic walls 11 was a SS400 steel, the wave height h (see FIG. 2A) of the wave-shaped bent sections was 900 μm, and the inter-vertex pitch p (see FIG. 2A) between two adjacent wave-shaped bent sections was 5 mm.

The simulation further assumed a case where a sorting target slurry was circulated through the wavelike matrix 10 from the near side in FIG. 3 (i.e., the side of the viewer who views the diagram; the same applies hereinafter) to the deep side (i.e., the deep side in the drawing sheet; the same applies hereinafter), or from the deep side to the near side, and a magnetic field generated by the electromagnet was applied in a magnetic field direction indicated by arrows in FIG. 3 (i.e., a direction orthogonal to the wave advancing direction of the magnetic walls 11).

The result of the simulation presents a magnetic force distribution in the matrix space in the housing part when the matrix space was sectioned along the wave advancing direction at a middle position of the magnetic walls 11 arranged in juxtaposition, the middle position being in a wave width direction.

As illustrated in FIG. 3, the simulation revealed that regions that were under relatively highly uniform magnetic forces occupied a most part of the matrix space between the magnetic walls 11 except for regions that were under locally-high and locally-low magnetic forces (BΔB [$T^2$/m]), and that portions of which surface was under a magnetic force that was in the range of the relatively highly uniform magnetic forces occupied a large area of the whole surface of each magnetic wall 11.

For example, a cross-sectional magnetic force distribution in a wavelike matrix having a wave height h of 900 m and an inter-vertex pitch p of 5 mm was as presented in Table 1 below under a condition that an air core magnetic flux density was 0.7 T. About 80 percent of the wavelike surface of the magnetic wall 11 could be concentrated to within a magnetic force range of from 50 $T^2$/m to 200 $T^2$/m.

Note that no simulation was conducted for a known matrix for a magnetic separator that is made of an expanded metal or steel wool, because such a matrix has a random magnetic force distribution that cannot be displayed simulatively.

TABLE 1

| | BΔB [$T^2$/m] | | | |
|---|---|---|---|---|
| | 0 to 50 | 50 to 200 | 200 to 600 | 600 or greater |
| Area ratio [%] | 7.0 | 79.8 | 11.2 | 2.0 |

(Examination about Wave Height h and Inter-Vertex Pitch p)

Next, simulation of a magnetic force distribution was conducted by appropriately varying the wave height h and inter-vertex pitch p (see FIG. 2A) of the magnetic walls 11 (see FIG. 3) of the wavelike matrix, in order to figure out a suitable wave height h and a suitable inter-vertex pitch p. The aforementioned analyzing software (FEMM 4.2, free software created by David Meeker) was used for the simulation.

The simulation assumed a case where the magnetic walls 11 were made of a SS400 steel having a thickness of 1.3 mm, and five magnetic walls 11 were arranged in juxtaposition with a distance of 3 mm between adjacent magnetic walls 11.

The simulation further assumed a case where a sorting target slurry was circulated through the wavelike matrix 10 from the near side in FIG. 3 (i.e., the side of the viewer who views the diagram; the same applies hereinafter) to the deep side (i.e., the deep side in the drawing sheet; the same applies hereinafter), or from the deep side to the near side, a magnetic field generated by the electromagnet was applied in a magnetic field direction indicated by arrows in FIG. 3 (i.e., a direction orthogonal to the wave advancing direction of the magnetic walls 11), and an air core magnetic flux density was 0.5 T.

In the simulation, a magnetic force distribution in the matrix space was calculated first, and then a magnetic force area cumulative rate of portions at which a magnetic force equal to or greater than a certain value was generated within a cross-section of the matrix space in the housing part was calculated, where the cross-section was obtained by sectioning the matrix space along the wave advancing direction at a wave-width-direction middle position of the magnetic walls arranged in juxtaposition.

FIGS. 4A to 4D illustrate relationships between the magnetic force (BΔB [$T^2$/m]) on the surface of the magnetic walls and a magnetic force area cumulative rate [%] of portions at which a magnetic force equal to or greater than a certain value was generated within the cross-section of the matrix space in the housing part, where the cross-section was obtained by sectioning the matrix space along the wave advancing direction at the wave-width-direction middle position of the magnetic walls arranged in juxtaposition.

Figure 4A:
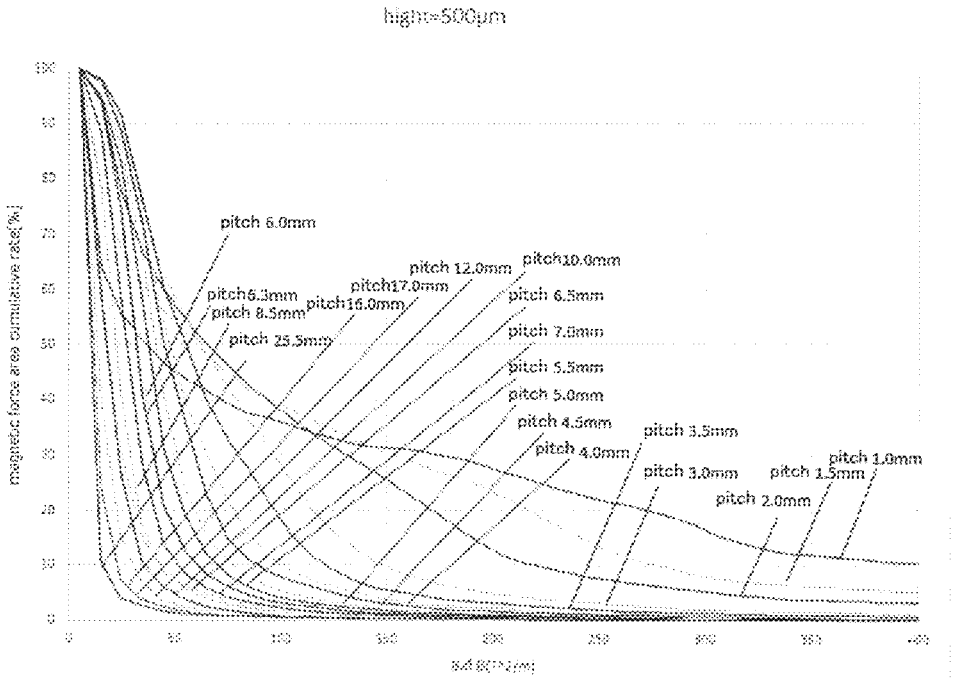
FIG. 4A is a diagram illustrating a relationship between a magnetic force on a cross-section of a matrix space inside the housing part and a magnetic force area cumulative rate of portions at which a magnetic force equal to or greater than a certain value is generated within the cross-section when the wave height h is 500 μm, where the cross-section is obtained by sectioning the matrix space along the wave advancing direction at a wave-width-direction middle position of the magnetic walls arranged in juxtaposition.
Figure 4B:
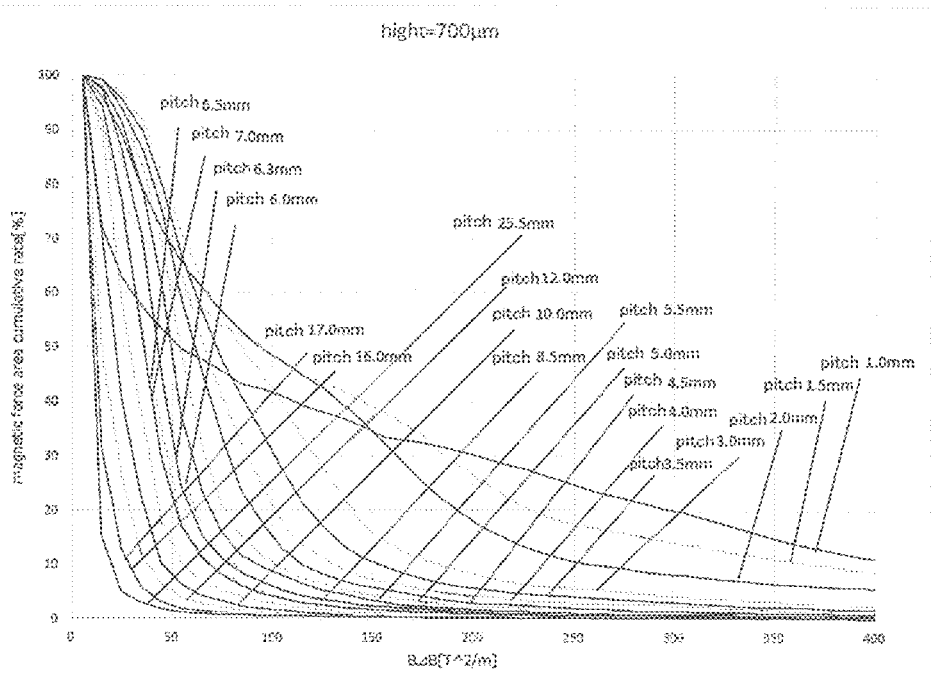
FIG. 4B is a diagram illustrating a relationship between a magnetic force on a cross-section of a matrix space inside the housing part and a magnetic force area cumulative rate of portions at which a magnetic force equal to or greater than a certain value is generated within the cross-section when the wave height h is 700 μm, where the cross-section is obtained by sectioning the matrix space along the wave advancing direction at a wave-width-direction middle position of the magnetic walls arranged in juxtaposition.
Figure 4C:
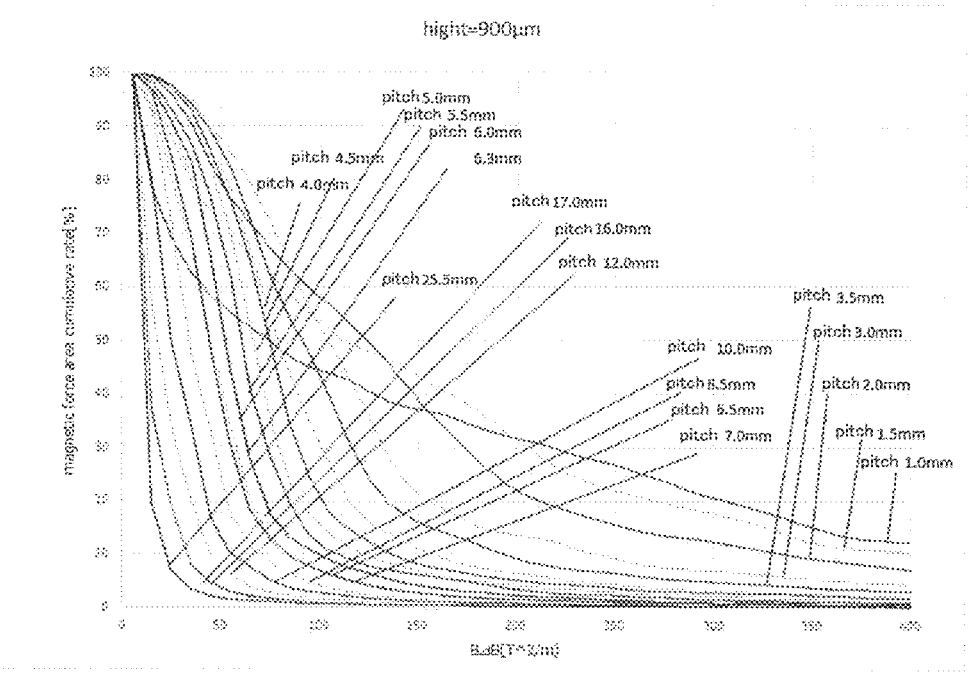
FIG. 4C is a diagram illustrating a relationship between a magnetic force on a cross-section of a matrix space inside the housing part and a magnetic force area cumulative rate of portions at which a magnetic force equal to or greater than a certain value is generated within the cross-section when the wave height is 900 μm, where the cross-section is obtained by sectioning the matrix space along the wave advancing direction at a wave-width-direction middle position of the magnetic walls arranged in juxtaposition.
Figure 4D:
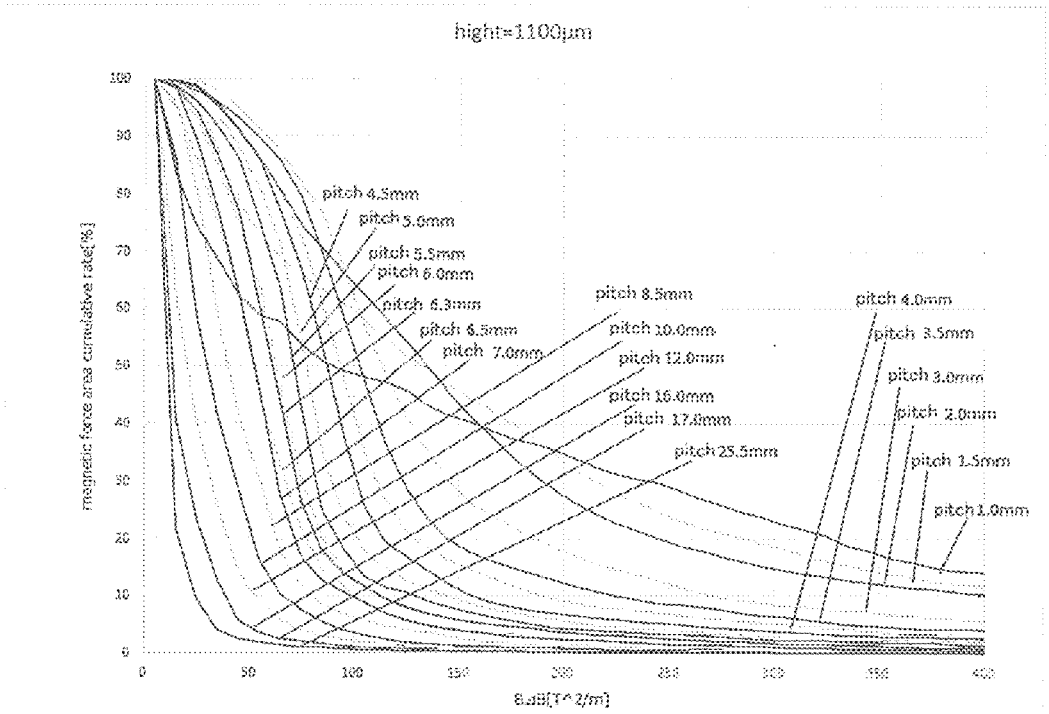
FIG. 4D is a diagram illustrating a relationship between a magnetic force on a cross-section of a matrix space inside the housing part and a magnetic force area cumulative rate of portions at which a magnetic force equal to or greater than a certain value is generated within the cross-section when the wave height is 1,100 μm, where the cross-section is obtained by sectioning the matrix space along the wave advancing direction at a wave-width-direction middle position of the magnetic walls arranged in juxtaposition.

FIG. 4A is a diagram illustrating a relationship between a magnetic force on a cross-section of the matrix space inside the housing part and a magnetic force area cumulative rate of portions at which a magnetic force equal to or greater than a certain value was generated within the cross-sectional portion when the wave height h was 500 μm, where the cross-section was obtained by sectioning the matrix space along the wave advancing direction at a wave-width-direction middle position of the magnetic walls arranged in juxtaposition. FIG. 4B is a diagram illustrating a relationship between a magnetic force on a cross-section of the matrix space inside the housing part and a magnetic force area cumulative rate of portions at which a magnetic force equal to or greater than a certain value was generated within the cross-sectional portion when the wave height h was 700 μm, where the cross-section was obtained by sectioning the matrix space along the wave advancing direction at a wave-width-direction middle position of the magnetic walls arranged in juxtaposition. FIG. 4C is a diagram illustrating a relationship between a magnetic force on a cross-section of the matrix space inside the housing part and a magnetic force area cumulative rate of portions at which a magnetic force equal to or greater than a certain value was generated within the cross-sectional portion when the wave height was 900 μm, where the cross-section was obtained by sectioning the matrix space along the wave advancing direction at a wave-width-direction middle position of the magnetic walls arranged in juxtaposition. FIG. 4D is a diagram illustrating a relationship between a magnetic force on a cross-section of the matrix space inside the housing part and a magnetic force area cumulative rate of portions at which a magnetic force equal to or greater than a certain value was generated within the cross-sectional portion when the wave height was 1,100 μm, where the cross-section was obtained by sectioning the matrix space along the wave advancing direction at a wave-width-direction middle position of the magnetic walls arranged in juxtaposition.

FIG. 4A to FIG. 4D each illustrate characteristics of respective variations corresponding to nineteen kinds of the inter-vertex pitch p that were set in a range of 1.0 mm to 25.5 mm.

Next, nonuniformity N of the magnetic force distribution in the matrix space was calculated for the obtained characteristics of the respective variations illustrated in FIGS. 4A to 4D according to the formula (1) given below.

$$N=(B\Delta B25-B\Delta B75)/B\Delta B50 \quad (1)$$

where in the formula (1) above, BΔB25 represents a magnetic force when a magnetic force area cumulative rate of portions at which a magnetic force equal to or greater than a certain value was generated within a cross-section of the matrix space inside the housing part was 25%, BΔB75 represents a magnetic force when the magnetic force area cumulative rate was 75%, and BΔB50 represents a magnetic force when the magnetic force area cumulative rate was 50%, where the cross-section was obtained by sectioning the matrix space along the wave advancing direction at the wave-width-direction middle position of the magnetic walls arranged in juxtaposition.

For example, in FIG. 4A, a system having a pitch of 5 mm was under a magnetic force of 59.25 $T^2/m$ when the magnetic force area cumulative rate of portions at which a magnetic force equal to or greater than a certain value was generated within the cross-section of the matrix space of the system was 25%. The value of 59.25 $T^2/m$ is used as BΔB25.

Figure 5:
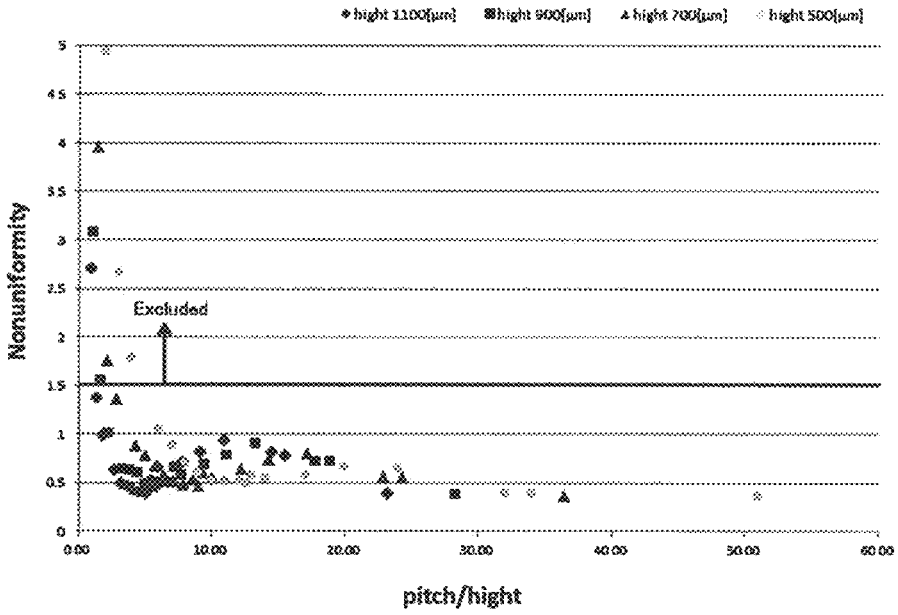
FIG. 5 is a diagram (1) illustrating a relationship between nonuniformity N and a ratio (pitch/height) of an inter-vertex pitch p to wave height h.

A greater nonuniformity N means a greater deviation in the magnetic force distribution, and a smaller nonuniformity N means a smaller deviation in the magnetic force distribution. Hence, any characteristic points that indicate the nonuniformity N of greater than 1.5 were excluded. This exclusion is illustrated in FIG. 5. FIG. 5 is a diagram (1) illustrating a relationship between nonuniformity N and a ratio (pitch/height) of the inter-vertex pitch p to the wave height h.

When characteristic points indicative of the nonuniformity N of greater than 1.5 were excluded based on FIG. 5 for enhancing uniformity of the magnetic force distribution, inter-vertex pitch p/wave height h (pitch/height), which is a ratio of the inter-vertex pitch p ([m]) to the wave height h ([m]), fell within a range represented by the following formula of 1.36≤inter-vertex pitch p/wave height h≤51.0 (condition 1).

Figure 6:
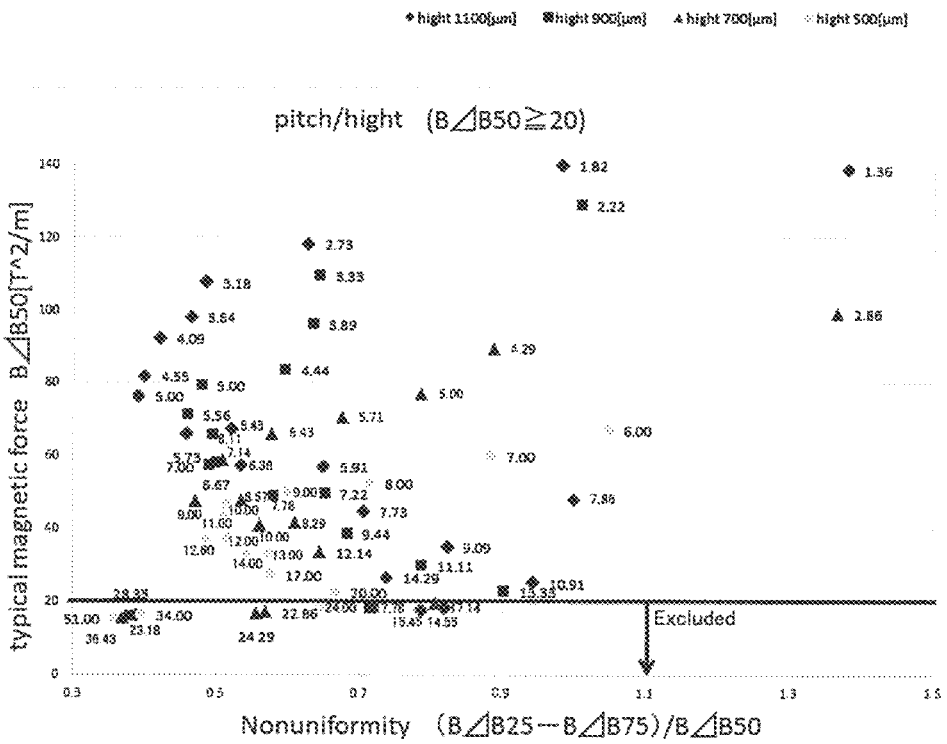
FIG. 6 is a diagram (1) illustrating a relationship between BΔB50 (a typical magnetic force BΔB50 [$T^2$/m]) and nonuniformity N.

When the BΔB50 value [$T^2/m$] that represents a typical magnetic force in the matrix space is less than 20 $T^2/m$ under a condition that the air core magnetic flux density is 0.5 T, a magnetic force available relative to an electric power supplied to the electromagnet is low, leading to a poor efficiency. Hence, characteristic points indicative of the BΔB50 value [$T^2/m$] of less than 20 $T^2/m$ were excluded next. This exclusion is illustrated in FIG. 6. FIG. 6 is a diagram (1) illustrating a relationship between BΔB50 (a typical magnetic force BΔB50 [$T^2/m$]) and nonuniformity N. Each data label in the diagram represents a pitch/height value.

When characteristic points indicative of the BΔB50 value [$T^2/m$] of less than 20 $T^2/m$ in addition to characteristic points indicative of the nonuniformity N of greater than 1.5 were excluded from FIG. 6, inter-vertex pitch p/wave height h (pitch/height), which is a ratio of the inter-vertex pitch p ([m]) to the wave height h ([m]), fell within a range represented by the following formula of 1.36≤inter-vertex pitch p/wave height h≤20.0 (condition 2).

Figure 7:
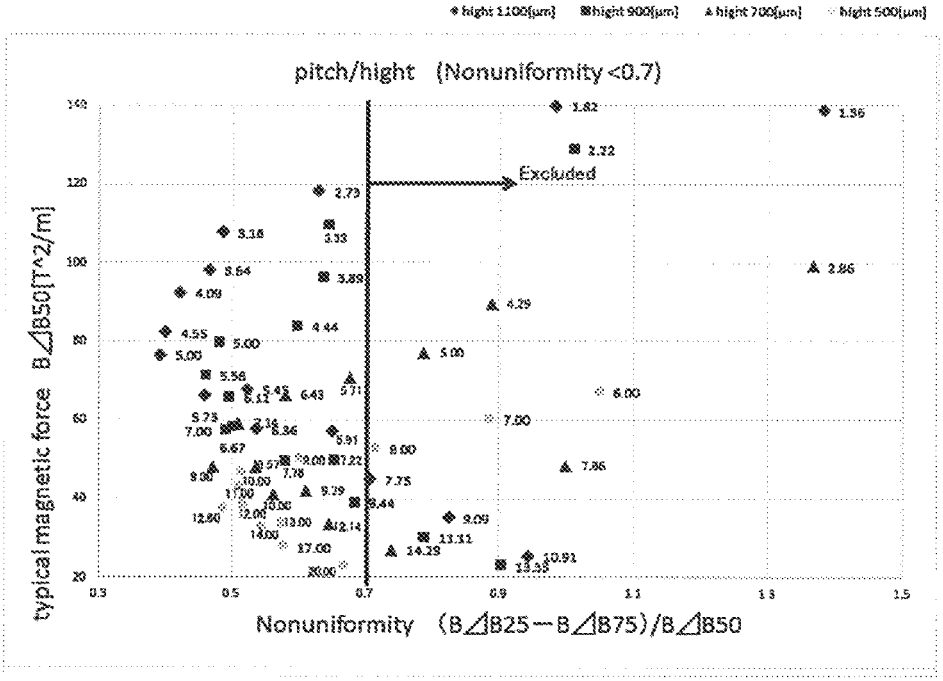
FIG. 7 is a diagram (2) illustrating a relationship between nonuniformity N and a ratio (pitch/height) of an inter-vertex pitch p to wave height h.

Further, characteristic points indicative of the nonuniformity N of greater than 0.7 were excluded for enhancing uniformity of the magnetic force distribution. This exclusion is illustrated in FIG. 7. FIG. 7 is a diagram (2) illustrating a relationship between nonuniformity N and a ratio (pitch/height) of the inter-vertex pitch p to the wave height h. Each data label in the diagram represents a pitch/height value.

When characteristic points indicative of the nonuniformity N of greater than 0.7 in addition to characteristic points indicative of the BΔB50 value [$T^2/m$] of less than 20 $T^2/m$ were excluded from FIG. 7, inter-vertex pitch p/wave height h (pitch/height), which is a ratio of the inter-vertex pitch p ([m]) to the wave height h ([m]), fell within a range represented by the following formula of 2.72≤inter-vertex pitch p/wave height h≤20.0 (condition 3).

Figure 8:
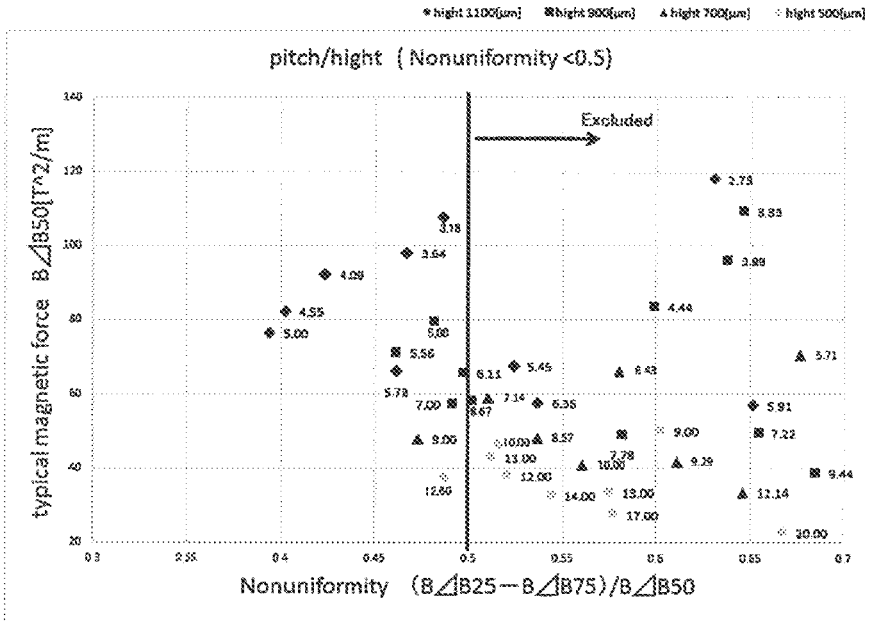
FIG. 8 is a diagram (3) illustrating a relationship between nonuniformity N and a ratio (pitch/height) of an inter-vertex pitch p to wave height h.

Yet further, characteristic points indicative of the nonuniformity N of greater than 0.5 were excluded for enhancing uniformity of the magnetic force distribution. This exclusion is illustrated in FIG. 8. FIG. 8 is a diagram (3) illustrating a relationship between nonuniformity N and a ratio (pitch/height) of the inter-vertex pitch p to the wave height h. Each data label in the diagram represents a pitch/height value.

When characteristic points indicative of the nonuniformity N of greater than 0.5 in addition to characteristic points indicative of the BΔB50 value [$T^2/m$] of less than 20 $T^2/m$ were excluded from FIG. 8, inter-vertex pitch p/wave height h (pitch/height), which is a ratio of the inter-vertex pitch p ([m]) to the wave height h ([m]), fell within a range represented by the following formula of 3.18≤inter-vertex pitch p/wave height h≤12.60 (condition 4).

Figure 9:
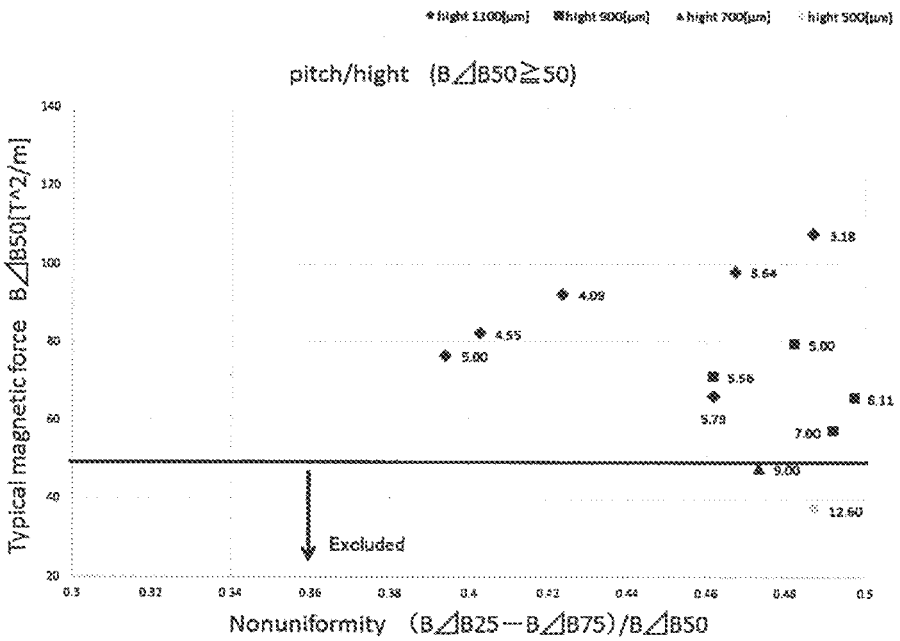
FIG. 9 is a diagram (2) illustrating a relationship between BΔB50 (a typical magnetic force BΔB50 [$T^2$/m]) and nonuniformity N.

Still further, cases where the BΔB50 value [$T^2/m$] was less than 50 $T^2/m$ under a condition that the air core magnetic flux density was 0.5 T were excluded for enabling efficient sorting with a higher magnetic force. This exclusion is illustrated in FIG. 9. FIG. 9 is a diagram (2) illustrating a relationship between BΔB50 (a typical magnetic force BΔB50 [$T^2/m$]) and nonuniformity N. Each data label in the diagram represents a pitch/height value.

When characteristic points indicative of the BΔB50 value [$T^2/m$] of less than 50 $T^2/m$ in addition to characteristic points indicative of the nonuniformity N of greater than 0.5 were excluded from FIG. 9, inter-vertex pitch p/wave height h (pitch/height), which is a ratio of the inter-vertex pitch p ([m]) to the wave height h ([m]), fell within a range represented by the following formula of 3.18≤inter-vertex pitch p/wave height h≤57.0 (condition 5).

From the above simulation results, inter-vertex pitch p/wave height h, which is a ratio of the inter-vertex pitch p to the wave height h in the magnetic walls of the wavelike matrix, is preferably in the range represented by the following formula of 1.36≤inter-vertex pitch p/wave height h≤51.0 (condition 1), more preferably in the range represented by the following formula of 1.36≤inter-vertex pitch p/wave height h≤20.0 (condition 2), yet more preferably in the range represented by the following formula of 2.72≤inter-vertex pitch p/wave height h≤20.0 (condition 3), still more preferably in the range represented by the following formula of 3.18≤inter-vertex pitch p/wave height h≤12.60 (condition 4), and particularly preferably in the range represented by the following formula of 3.18≤inter-vertex pitch p/wave height h≤7.0 (condition 5).

(Coating of Magnetic Walls with Non-Magnetic Substance)

Next, a comparative simulation of magnetic force distributions in the wavelike matrix (see FIG. 3) and in a coated wavelike matrix obtained by coating the surface of the magnetic walls of the wavelike matrix with a non-magnetic substance was conducted with the aforementioned analyzing software.

Figure 10:
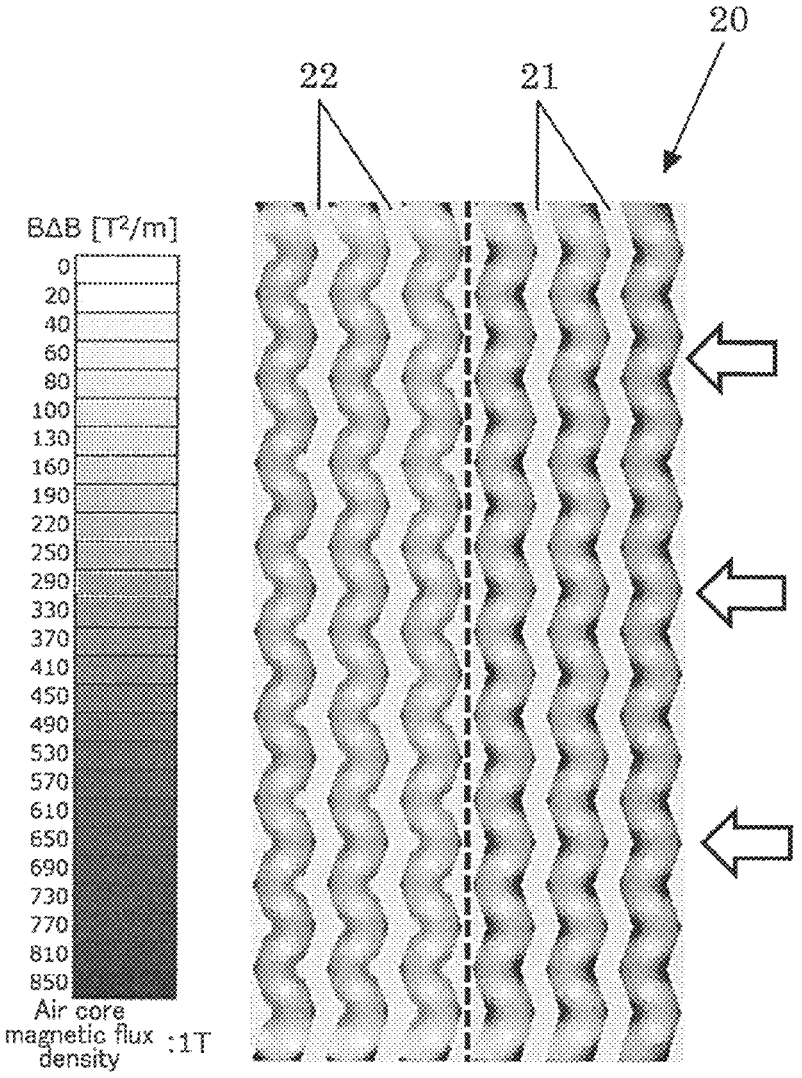
FIG. 10 is a diagram illustrating configurations of a coated wavelike matrix and a wavelike matrix for which a comparative simulation was conducted, and a result of a finite element method-based simulation of a magnetic force (BΔB) distribution for the matrices under a condition that a density of a magnetic flux generated by an electromagnet formed of an air core coil (i.e., air core magnetic flux density) is 1 T.

FIG. 10 illustrates the configurations of the coated wavelike matrix and the wavelike matrix for which the comparative simulation was conducted, and a result of a finite element method-based simulation of a magnetic force (BΔB) distribution for each matrix (matrix 70) under a condition that a density of a magnetic flux generated by an electromagnet formed of an air core coil (i.e., air core magnetic flux density) was 1 T. The comparative simulation assumed a case where a sorting target slurry was circulated through the matrix 20 from the near side to the deep side or from the deep side to the near side in FIG. 10, and a magnetic field generated by the electromagnet was applied in a magnetic field direction indicated by arrows in FIG. 10. In FIG. 10, the reference sign 21 denotes the magnetic walls of the wavelike matrix, and the reference sign 22 denotes the magnetic walls obtained by coating the surface of these magnetic walls with a non-magnetic substance. The target of this simulation was a magnetic force distribution in the matrix space in the housing part when the matrix space was sectioned along the wave advancing direction at a wave-width-direction middle position of the magnetic walls 21 or 22 arranged in juxtaposition.

The wavelike matrix of which surface was coated with a non-magnetic substance was able to prevent particles from entering portions that were under a relatively high magnetic force and were present in the vicinity of the vertices of the wave-shaped bent sections. This enabled the magnetic force in the space between the magnetic walls 22 of the coated wavelike matrix to be more uniform than the magnetic force in the space between the magnetic walls 21 of the wavelike matrix. For example, regions that were around the vertices of the wave-shaped bent section and in which BΔB≥600 accounted for about 7% of a cross-sectional magnetic force distribution of the wavelike matrix having a wave height h of 0.9 mm and an inter-vertex pitch p of 5 mm under a condition that an air core magnetic flux density was 1 T. The percentage of such regions could be reduced to about 2% when the vertices were coated with a non-magnetic substance (with a relative magnetic permeability of 1.0) having a thickness of 0.3 mm.

(Shortened Interval Matrix)

Next, a magnetic force distribution of a shortened interval matrix was simulated with the aforementioned analyzing software.

Figure 11:
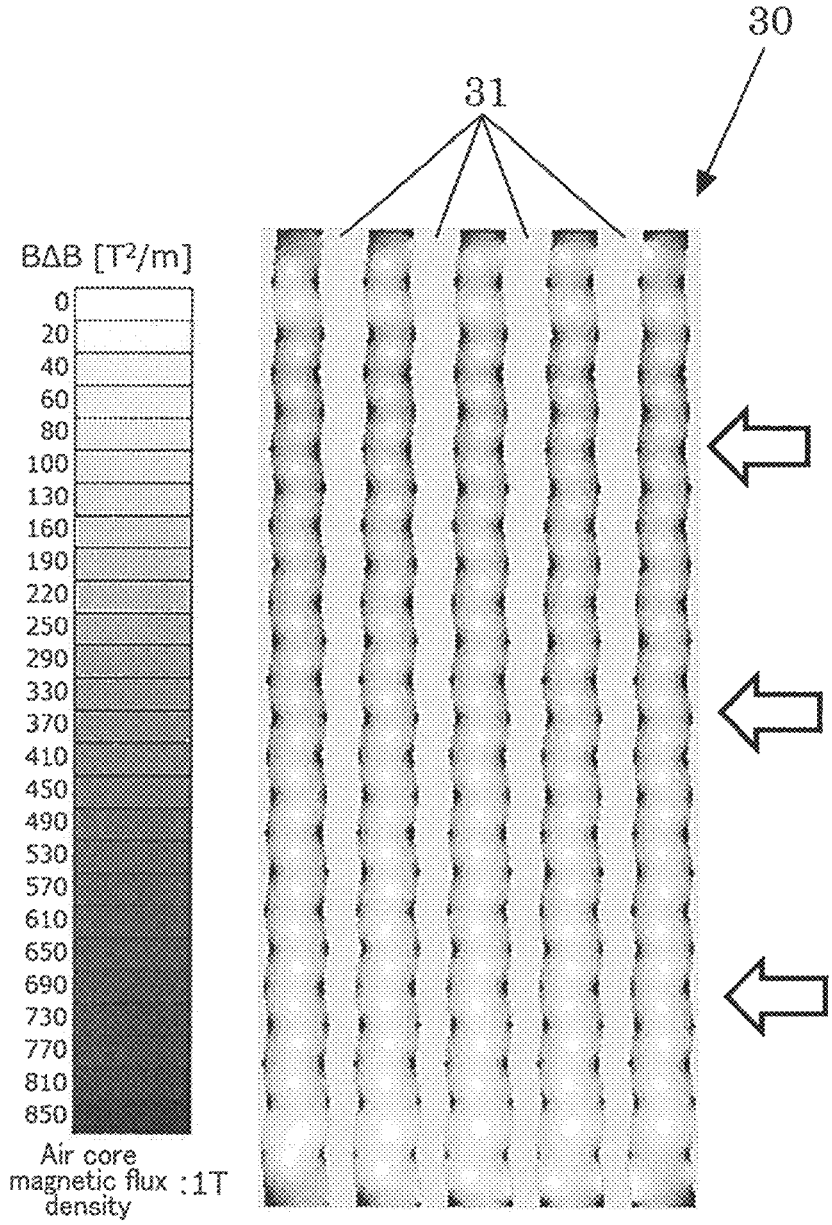
FIG. 11 is a diagram illustrating a configuration of a shortened interval matrix for which simulation was conducted, and a result of a finite element method-based simulation of a magnetic force (BΔB) distribution for the shortened interval matrix under a condition that a density of a magnetic flux generated by an electromagnet formed of an air core coil (i.e., air core magnetic flux density) is 1 T.

FIG. 11 illustrates the configuration of the shortened interval matrix for which the simulation was conducted, and a result of a finite element method-based simulation of a magnetic force (BΔB) distribution for the shortened interval matrix under a condition that a density of a magnetic flux generated by an electromagnet formed of an air core coil (i.e., air core magnetic flux density) was 1 T.

As illustrated in FIG. 11, the shortened interval matrix 30 is configured such that the sorting target slurry is circulated therethrough from the lower side to the upper side in the drawing. Further, as illustrated in FIG. 11, the magnetic walls 31 in each of which a plurality of wave-shaped bent sections are orderly provided when seen in a cross-sectional view are arranged in juxtaposition in the direction of the thickness of the walls, and in a manner that each magnetic wall 31 gradually increase its thickness in the direction in which the sorting target fluid is circulated, such that the interval between the magnetic walls 31 arranged in juxtaposition decreases in the circulation direction of the sorting target slurry. This simulation assumed a case where a magnetic field generated by the electromagnet was applied in a magnetic field direction indicated by arrows in FIG. 11. The result of the simulation presents a magnetic force distribution in the matrix space in the housing part when the matrix space was sectioned along the wave advancing direction at the wave-width-direction middle position of the magnetic walls 31 arranged in juxtaposition.

In this shortened interval matrix 30, advancement from an earlier stage (lower side in the drawing) to a later stage (upper side) along the circulation direction of the sorting target slurry is accompanied by gradual reduction of voidage in the shortened interval matrix 30. That is, in the configuration example illustrated in FIG. 11, advancement by 51 mm in the circulation direction is accompanied by reduction by 1 mm in the interval between the magnetic walls 31 arranged in juxtaposition. This provides a higher voidage at the earlier stage and creates a condition that some magnetic materials cannot probabilistically approach the magnetic walls 31 at the earlier stage, which makes the magnetic materials sequentially approach the magnetic walls 31 and be magnetically attracted thereto at or past the middle stage (i.e., about the center in the drawing). This enables effective use of the magnetic attraction area.

Here, the broader space at the earlier stage not only provides a lower probability of contact with the surface of the magnetic walls 31 but also provides the space at the earlier stage with a magnetic force lower than a magnetic force at the later stage. Hence, when the magnetically attractable substance to be recovered includes a plurality of kinds of magnetic materials different in magnetic susceptibility, a magnetic material having a higher magnetic susceptibility can be recovered at the earlier stage, and a magnetic material having a lower magnetic susceptibility can be recovered at the later stage.

Under conditions that the magnetic force distribution is uniform from the earlier stage to the later stage in the circulation direction and that the magnetic force is a level capable of recovering the magnetic material having a lower magnetic susceptibility, the amount of magnetic materials magnetically attracted at the earlier stage in the circulation direction is high. The high amount of magnetic materials magnetically attracted gives a prediction that the flow path will be blocked relatively quickly at the earlier stage in the circulation direction. However, the shortened interval between the magnetic walls arranged in juxtaposition in the wavelike matrix enables the magnetic material having a higher magnetic susceptibility to be recovered at the earlier stage and the magnetic material having a lower magnetic susceptibility to be recovered at the later stage for them to be magnetically attracted at dispersed areas. This enables highly efficient magnetic separation of the magnetic materials with the matrix for a magnetic separator.

(Container Made of Different Materials)

Magnetic flux (B-S) distributions in cases where the wavelike matrix was housed in a housing part constituted by external walls made of different materials (SS400 steel (magnetic substance) and SUS304 steel (non-magnetic substance)) and where the wavelike matrix was housed in a housing part constituted by external walls made of the same material (SS400 steel) were simulated with the aforementioned analyzing software. The target of this simulation was a magnetic force distribution in the matrix space in the housing part when the matrix space was sectioned along the wave advancing direction at the wave-width-direction middle position of the magnetic walls 11 arranged in juxtaposition.

Figure 12A:
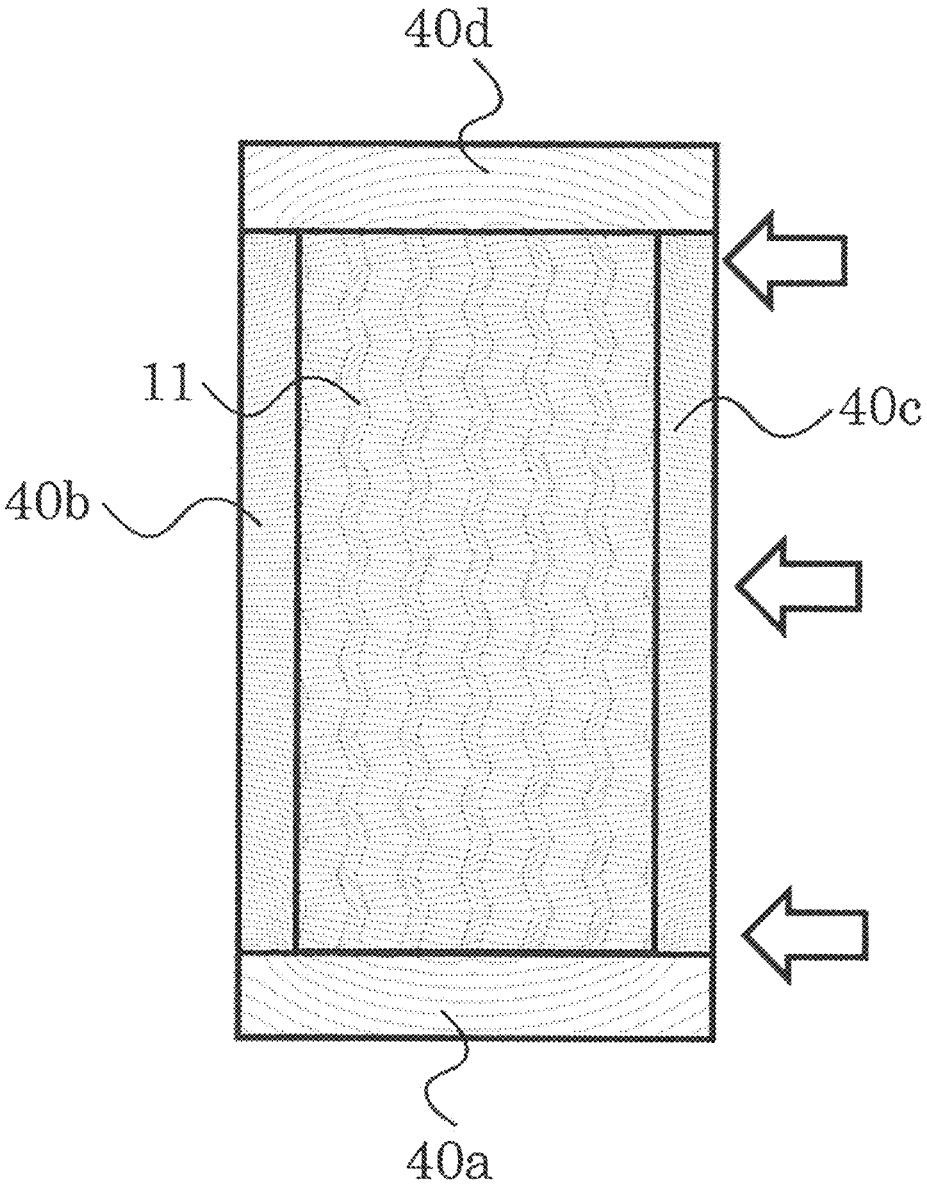
FIG. 12A is a diagram illustrating a result of a finite element method-based simulation of a magnetic flux (B-S) distribution under conditions that an air core magnetic flux density is 1 T and external walls are made of different materials.
Figure 12B:
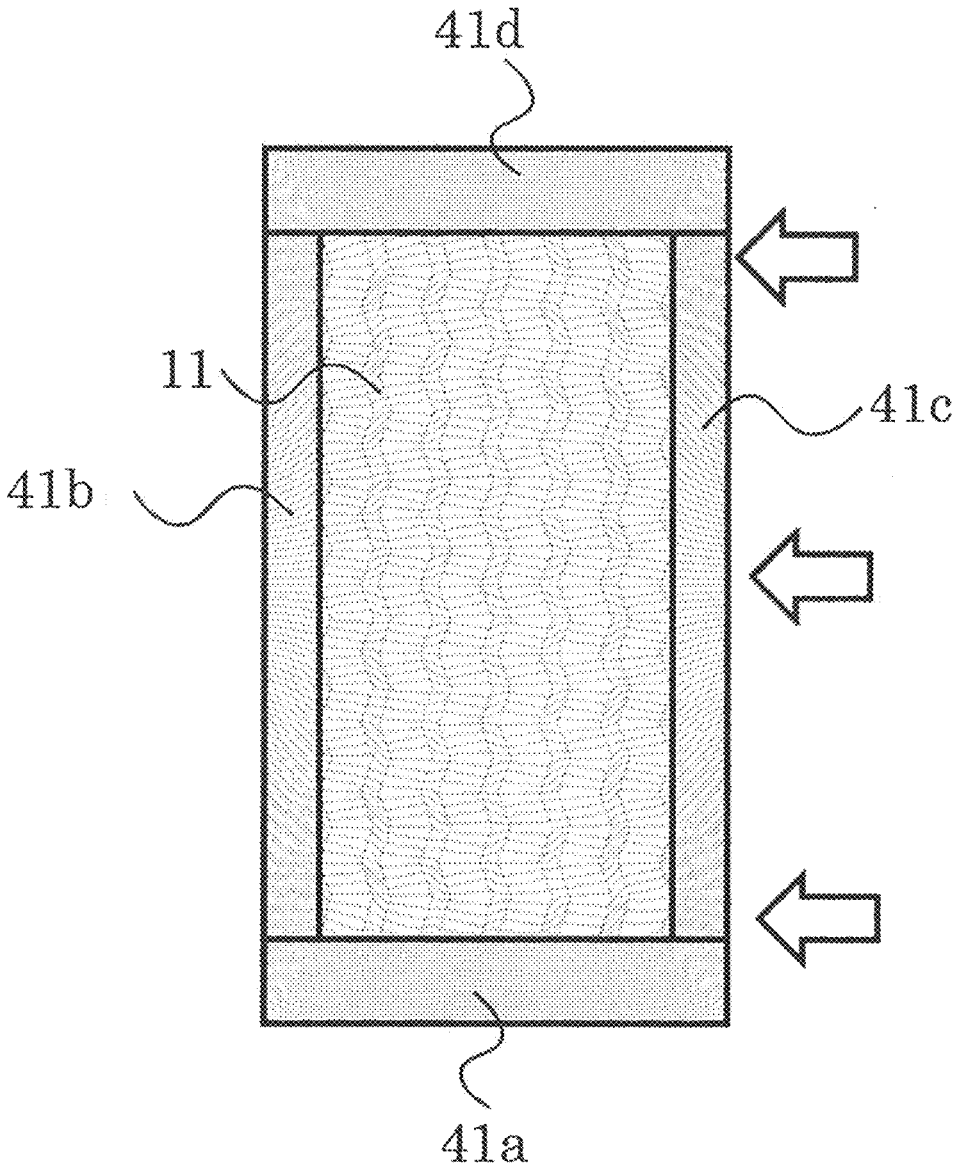
FIG. 12B is a diagram illustrating a result of a finite element method-based simulation of a magnetic flux (B-S) distribution under conditions that an air core magnetic flux density is 1 T and external walls are made of the same material.

FIG. 12A illustrates the result of a finite element method-based simulation of the magnetic flux (B-S) distribution in the case where the housing part was constituted by external walls made of different materials under a condition that the air core magnetic flux density was 1 T. FIG. 12B illustrates the result of a finite element method-based simulation of the magnetic flux (B-S) distribution in the case where the housing part was constituted by external walls made of the same material under a condition that the air core magnetic flux density was IT. In FIG. 12A, the reference signs 40*a* and 40*d* denotes the external walls made of SUS304 steel, and the reference signs 40*b* and 40*c* denotes the external walls made of SS400 steel. In FIG. 12B, the external walls denoted by the reference signs 41*a* to 41*d* are all made of SS400 steel. In each drawing, the arrows indicate the magnetic field direction.

In the case where the housing part was constituted by external walls made of different materials, there was little magnetic flux leakage to the outside of the matrix for a magnetic separator, and the magnetic flux could concentrate to within the matrix for a magnetic separator. This enabled the magnetic force in the space between the magnetic walls to be relatively high. According to the results of the simulations illustrated in FIGS. 12A and 12B, an amount of the magnetic flux generated by the electromagnet that could concentrate to within the matrix for a magnetic separator in the case where the external walls were made of different materials was greater by about 15% than in the case where the external walls were made of the same material.

Example

A magnetic separator according to Example was produced by employing the wavelike matrix 10 (see FIG. 3) having a wave height h of 300 μm and an inter-vertex pitch p of 4 mm as a matrix 50*b* for a magnetic separator in the magnetic separator 100 illustrated in FIG. 1A. A sorting test was performed with this magnetic separator in the manner described below.

The sorting target slurry used was a slurry having a solid concentration of 10% that was obtained by mixing two kinds of solid particles presented in Table 2 below (a sample A with a high magnetic susceptibility; a green phosphor LAP and a sample B with a low magnetic susceptibility; a red phosphor YOX) in pure water in which a dispersant NOPCOSANT RFA available from San Nopco Ltd. (0.15% by mass) and a dispersant SN WET 980 available from San Nopco Ltd. (0.015% by mass) were added. In a state that the electromagnet was excited, the sorting target slurry was introduced into the magnetic separation flow path through the sorting target fluid introducing flow path at a flow rate of about 0.5 L/min, and the slurry recovered from the non-magnetically attractable substance recovering section was obtained as a non-magnetically attractable slurry (non-magnetically attractable substance). Next, after the electromagnet was demagnetized, the carrier fluid (water) was introduced into the magnetic separation flow path through the carrier fluid introducing flow path at a flow rate of about 20 L/min, and the slurry recovered from the magnetically attractable substance recovering section was obtained as a magnetically attractable slurry (magnetically attractable substance).

TABLE 2

| Sample | Magnetic susceptibility | Particle size (μm) D50 | Particle size (μm) D80 | Mixing ratio |
|---|---|---|---|---|
| Sample A with high magnetic susceptibility | $1.08 \times 10^{-3}$ | 5.0 | 6.4 | 0.425 |
| Sample B with low magnetic susceptibility | $7.79 \times 10^{-5}$ | 6.3 | 8.2 | 0.575 |

Comparative Example

A magnetic separator according to Comparative Example was produced by employing a conventional expanded metal (EXPANDED METAL EX-8R (constituent material: SUS410) available from Eriez Magnetics Japan Co., Ltd.), in place of the wavelike matrix 30, and a sorting test similar to the sorting test of Example was performed.

The results of the sorting tests in Example (wavelike matrix) and Comparative Example (expanded metal) are presented in Table 3 below.

In Table 3 below, "split ratio (extraction rate)" gives the ratio at which the sample A with a high magnetic susceptibility, the sample B with a low magnetic susceptibility, and the whole sample in which the sample A with a high magnetic susceptibility and the sample B with a low magnetic susceptibility were added together were each split into the magnetically attractable slurry and the non-magnetically attractable slurry. The split ratio at which the sample A with a high magnetic susceptibility, the sample B with a low magnetic susceptibility, and the whole sample in which the sample A with a high magnetic susceptibility and the sample B with a low magnetic susceptibility were added together were each split into the magnetically attractable slurry is given in (%) in the fields under "magnetically attractable substance", and the split ratio at which the sample A with a high magnetic susceptibility, the sample B with a low magnetic susceptibility, and the whole sample in which the sample A with a high magnetic susceptibility and the sample B with a low magnetic susceptibility were added together were each split into the non-magnetically attractable slurry is given in (%) in the fields under "non-magnetically attractable substance".

"Purity (grade)" gives the content ratio at which each of the sample A with a high magnetic susceptibility and the sample B with a low magnetic susceptibility was contained in each of the magnetically attractable slurry and the non-magnetically attractable slurry. The content ratio at which each of the sample A with a high magnetic susceptibility and the sample B with a low magnetic susceptibility was contained in the magnetically attractable slurry is given in (%) in the fields under "magnetically attractable substance", and the content ratio at which each of the sample A with a high magnetic susceptibility and the sample B with a low magnetic susceptibility was contained in the non-magnetically attractable slurry is given in (%) in the fields under "non-magnetically attractable substance".

"Separation efficiency" gives a value obtained by subtracting the split ratio at which the sample B with a low magnetic susceptibility was split into the magnetically attractable slurry from the split ratio at which the sample A with a high magnetic susceptibility was split into the magnetically attractable slurry (the value being equal to a value obtained by subtracting the split ratio at which the sample A with a high magnetic susceptibility was split into the non-magnetically attractable slurry from the split ratio at which the sample B with a low magnetic susceptibility was split into the non-magnetically attractable slurry).

TABLE 3

| | Split ratio (extraction rate) (%) | | | Purity (grade) (%) | | | |
|---|---|---|---|---|---|---|---|
| | Magnetically attractable substance | Non-magnetically attractable substance | Total | Before magnetic separations | Magnetically attractable substance | Non-magnetically attractable substance | Separation efficiency (%) |
| Wavelike matrix | | | | | | | |
| Whole | 42.4 | 57.6 | 100 | 100 | 100 | 100 | |
| Sample A with high magnetic susceptibility | 75.5 | 24.5 | 100 | 42.5 | 83.1 | 21.0 | 66.3 |
| Sample B with low magnetic susceptibility | 9.2 | 90.8 | 100 | 57.5 | 16.9 | 79.0 | |
| Expanded metal | | | | | | | |
| Whole | 20.9 | 79.1 | 100 | 100 | 100 | 100 | |
| Sample A with high magnetic susceptibility | 30.2 | 69.8 | 100 | 42.5 | 65.3 | 38.1 | 18.7 |
| Sample B with low magnetic susceptibility | 11.5 | 88.5 | 100 | 57.5 | 34.7 | 61.9 | |

As presented in Table 3 above, the separation efficiency (66.3%) of the magnetic separator according to Example in which the matrix for a magnetic separator was constituted by the wavelike matrix is significantly higher than the separation efficiency (18.7%) of the magnetic separator according to Comparative Example in which the matrix for a magnetic separator was constituted by an expanded metal. It was confirmed that a high sorting performance was obtained in Example.

REFERENCE SIGNS LIST

1, 1', 11, 21, 22, 31 magnetic wall
1*a*, 1*b*, 1*a*', 1*b*' wave-shaped bent section
10 wavelike matrix
20 coated wavelike matrix
30 shortened interval matrix
40*a*, 40*d* external walls (SUS304 steel)
40*b*, 40*c* external walls (SS400 steel)
41*a* to 40*d* external walls (SS400 steel)
50 high gradient magnetic separating section
50*a* electromagnet
50*b* matrix for a magnetic separator
50*c* magnetic separation flow path
100 magnetic separator
101*a*, 103*a*, 104*a*, 105*a* on-off valve
101*b* sorting target fluid introducing flow path
101*c* storing section
101*d* pump
103*b* non-magnetically attractable substance discharging flow path
103*c* non-magnetically attractable substance recovering section
104*b* carrier fluid introducing flow path
105*b* magnetically attractable substance discharging flow path
h wave height
p inter-vertex pitch

The invention claimed is:

1. A matrix for a magnetic separator, comprising:

wavy plate-shaped magnetic walls each having an orderly structure in which wave-shaped bent sections each having a wave height h of 1 mm or less and formed in either an approximately inverted V-shape or an approximately inverted U-shape are continuously and repeatedly formed in a wave advancing direction; and a box-shaped housing part housing the magnetic walls and having in opposite surfaces of the housing part respectively, an introducing part and a discharging part through which a sorting target fluid including a magnetically attractable substance magnetically attractable to the magnetic walls are capable of being passed into and out from the housing part, wherein the magnetic walls are arranged in juxtaposition in a state that convex shapes of the wave-shaped bent sections in one magnetic wall of the magnetic walls and concave shapes of the wave-shaped bent sections in another magnetic wall of the magnetic walls that is adjacent to the one magnetic wall face each other with a constant interval therebetween, wherein the wave height h of the wave-shaped bent sections and a pitch p between vertices of adjacent ones of the wave-shaped bent sections are set such that nonuniformity N, represented by a formula (1) below, of a magnetic force generated in a space inside the housing part when a magnetic field is applied is less than 0.7, $$N=(B\Delta B25-B\Delta B75)/B\Delta B50 \quad (1)$$

where in the formula (1) above, BΔB25 represents the magnetic force when a magnetic force area cumulative rate of portions at which the magnetic force equal to or greater than a certain value is generated within a cross-section of the space inside the housing part is 25%, BΔB75 represents the magnetic force when the magnetic force area cumulative rate is 75%, and BΔB50 represents the magnetic force when the magnetic force area cumulative rate is 50%, where the cross-section is obtained by sectioning the space inside the housing part along the wave advancing direction at a middle position of the magnetic walls arranged in juxtaposition, the middle position being in a direction of a width of waves, and wherein the ratio of inter-vertex pitch p and wave height h (p/b) is ≥2.72 and ≤20.0.

2. The matrix for a magnetic separator according to claim 1, wherein a wall material of side surfaces of the housing part that are disposed orthogonally to a magnetic flux direction is made of a magnetic substance, and a wall material of remaining side surfaces of the housing part is made of a non-magnetic substance, where the surfaces of the housing part that have the introducing part and the discharging part respectively are assumed to be a top surface and a bottom surface of the housing part.

3. The matrix for a magnetic separator according to claim 1, wherein a surface of the magnetic walls is coated with a non-magnetic substance having a relative magnetic permeability of 1.1 or less.

4. The matrix for a magnetic separator according to claim 1, wherein the magnetic walls are arranged in a state of being inclined from a direction along which the sorting target fluid is introduced into the housing part.

5. The matrix for a magnetic separator according to claim 1, wherein the magnetic walls have a thickness that increases from the introducing part through which the sorting target fluid is introduced into the housing part toward the discharging part through which the sorting target fluid is discharged from the housing part.

6. A magnetic separator, comprising:

a matrix for a magnetic separator, wherein the matrix for a magnetic separator comprises:

wavy plate-shaped magnetic walls each having an orderly structure in which wave-shaped bent sections each having a wave height h of 1 mm or less and formed in either an approximately inverted V-shape or an approximately inverted U-shape are continuously and repeatedly formed in a wave advancing direction; and a box-shaped housing part housing the magnetic walls and having in opposite surfaces of the housing part respectively, an introducing part and a discharging part through which a sorting target fluid including a magnetically attractable substance magnetically attractable to the magnetic walls are capable of being passed into and out from the housing part, and wherein the magnetic walls are arranged in juxtaposition in a state that convex shapes of the wave-shaped bent sections in one magnetic wall of the magnetic walls and concave shapes of the wave-shaped bent sections in another magnetic wall of the magnetic walls that is adjacent to the one magnetic wall face each other with a constant interval therebetween, wherein the wave height h of the wave-shaped bent sections and a pitch p between vertices of adjacent ones of the wave-shaped bent sections are set such that nonuniformity N, represented by a formula (1) below, of a magnetic force generated in a space inside the housing part when a magnetic field is applied is less than 0.7, $$N=(B\Delta B25-B\Delta B75)/B\Delta B50 \quad (1)$$

where in the formula (1) above, BΔB25 represents the magnetic force when a magnetic force area cumulative rate of portions at which the magnetic force equal to or greater than a certain value is generated within a cross-section of the space inside the housing part is 25%, BΔB75 represents the magnetic force when the magnetic force area cumulative rate is 75%, and BΔB50 represents the magnetic force when the magnetic force area cumulative rate is 50%, where the cross-section is obtained by sectioning the space inside the housing part along the wave advancing direction at a middle position of the magnetic walls arranged in juxtaposition, the middle position being in a direction of a width of waves, and wherein the ratio of inter-vertex pitch p and wave height h (p/h) is ≥2.72 and ≤20.0.

7. The magnetic separator according to claim 6, further comprising:

a display unit capable of displaying a magnetic force distribution in the space inside the housing part in real-time, the magnetic force distribution previously calculated by a magnetic field simulation according to output information from an electromagnet.

* * * * *